US007954213B2

(12) United States Patent
Mizutani et al.

(10) Patent No.: US 7,954,213 B2
(45) Date of Patent: Jun. 7, 2011

(54) NONWOVEN FABRIC, NONWOVEN FABRIC MANUFACTURING METHOD, AND NONWOVEN FABRIC MANUFACTURING APPARATUS

(75) Inventors: Satoshi Mizutani, Kagawa (JP); Yuki Noda, Kagawa (JP); Hideyuki Ishikawa, Kagawa (JP); Akihiro Kimura, Kagawa (JP)

(73) Assignee: Uni-Charm Corporation, Shikokuchuo-shi (JP)

( * ) Notice: Subject to any disclaimer, the term of this patent is extended or adjusted under 35 U.S.C. 154(b) by 575 days.

(21) Appl. No.: 11/764,899

(22) Filed: Jun. 19, 2007

(65) Prior Publication Data

US 2008/0010795 A1 Jan. 17, 2008

(30) Foreign Application Priority Data

Jun. 23, 2006 (JP) ..... 2006-174504

(51) Int. Cl.
*D04H 1/40* (2006.01)

(52) U.S. Cl. ..... 28/104; 28/167; 156/62.2

(58) Field of Classification Search ..... 28/104, 28/105, 106, 167; 68/200, 205 R, 204; 162/116, 162/296, 358.2, 900, 902, 903, 348, 109, 162/115; 156/62.2, 148, 251, 497
See application file for complete search history.

(56) References Cited

U.S. PATENT DOCUMENTS 2,862,251 A * 12/1958 Kalwaites ..... 264/119
3,033,721 A * 5/1962 Kalwaites ..... 442/50
3,034,180 A * 5/1962 Greiner et al. ..... 19/301
3,042,576 A * 7/1962 Harmon et al. ..... 162/114
3,113,349 A * 12/1963 Nottebohm et al. ..... 264/119
3,322,584 A * 5/1967 Welin-Berger ..... 156/82
3,322,617 A * 5/1967 Osborne ..... 162/296
3,458,905 A * 8/1969 Dodson, Jr. et al. ..... 28/104
3,485,706 A * 12/1969 Evans ..... 428/134
3,688,355 A * 9/1972 Okzaki et al. ..... 28/104
3,750,237 A * 8/1973 Kalwaites ..... 28/105
3,769,659 A * 11/1973 Kalwaites ..... 28/104

(Continued)

FOREIGN PATENT DOCUMENTS

JP 02-229255 A 9/1990

(Continued)

OTHER PUBLICATIONS

International Search Report of PCT/JP2007/061800 issued on Aug. 7, 2007.

*Primary Examiner* — Amy B Vanatta
(74) *Attorney, Agent, or Firm* — Lowe, Hauptman, Ham & Berner, LLP

(57) ABSTRACT

The present invention provides a nonwoven fabric of which at least one of fiber orientation, fiber density, and basis weight is adjusted, and in which at least one of a predetermined groove portion, an opening, and a protrusion is formed, a manufacturing method for the nonwoven fabric, and a nonwoven fabric manufacturing apparatus. The nonwoven fabric manufacturing apparatus of the present invention manufactures a nonwoven fabric of which at least one of fiber orientation, fiber density, and basis weight is adjusted, or in which at least one of a predetermined groove portion, an opening, and a protrusion is formed by blowing fluid mainly containing gas onto a fiber web which is formed in a sheet shape, and which is in a state where at least a portion of the fibers constituting the fiber aggregate has a degree of freedom.

22 Claims, 17 Drawing Sheets

U.S. PATENT DOCUMENTS

| | | | | | |
|---|---|---|---|---|---|
| 3,787,932 | A | * | 1/1974 | Kalwaites | 28/105 |
| 4,528,239 | A | * | 7/1985 | Trokhan | 442/33 |
| 5,115,544 | A | * | 5/1992 | Widen | 28/105 |
| 5,167,745 | A | * | 12/1992 | Governale | 156/285 |
| 5,274,893 | A | * | 1/1994 | Kitamura et al. | 28/105 |
| 5,804,281 | A | * | 9/1998 | Phan et al. | 428/137 |
| 5,895,623 | A | * | 4/1999 | Trokhan et al. | 264/504 |
| 6,117,270 | A | * | 9/2000 | Trokhan | 162/109 |
| 6,171,447 | B1 | * | 1/2001 | Trokhan | 162/358.2 |
| 6,576,090 | B1 | * | 6/2003 | Trokhan et al. | 162/348 |
| 6,743,571 | B1 | * | 6/2004 | Hill et al. | 430/306 |
| 2006/0042057 | A1 | * | 3/2006 | Taniguchi et al. | 28/104 |
| 2006/0108047 | A1 | * | 5/2006 | Lorenz et al. | 156/62.2 |
| 2007/0256286 | A1 | * | 11/2007 | Ngai | 28/106 |
| 2007/0298213 | A1 | * | 12/2007 | Noda et al. | 428/131 |

FOREIGN PATENT DOCUMENTS

| | | | | |
|---|---|---|---|---|
| JP | 04-100958 | A | | 4/1992 |
| JP | 09-302562 | A | | 11/1997 |
| JP | 2002-030557 | A | | 1/2002 |
| JP | 2002-249965 | A | | 9/2002 |
| JP | 2003-291234 | A | | 10/2003 |
| JP | 57-47958 | S | | 7/2008 |
| WO | WO 95/06769 | | * | 3/1995 |

* cited by examiner

NONWOVEN FABRIC, NONWOVEN FABRIC MANUFACTURING METHOD, AND NONWOVEN FABRIC MANUFACTURING APPARATUS

This application is based on and claims the benefit of priority from Japanese Patent Application No. 2006-174504, filed on 23 Jun. 2006, the content of which is incorporated herein by reference.

BACKGROUND OF THE INVENTION

1. Field of the Invention

The present invention relates to a nonwoven fabric, a nonwoven fabric manufacturing method, and a nonwoven fabric manufacturing apparatus.

2. Related Art

Conventionally, nonwoven fabrics have been used in a wide range of fields including sanitary goods such as disposable diapers and sanitary napkins, cleaning goods such as wipers, and medical supplies such as masks. As described above, nonwoven fabrics have been used in various different fields; however, it is necessary to manufacture them so as to have properties and structures suitable for application of each product if they are actually applied in products in each field.

Nonwoven fabrics are manufactured by, for example, forming a fiber layer (fiber web) by means of a dry method, a wet process, or the like, and bonding fibers in the fiber layer to each other by means of a chemical bonding method, a thermal bonding method, or the like. In a process of bonding the fibers used for forming the fiber layer, methods of applying external physical forces to the fiber layer exist such as a method of repeatedly sticking multiple needles into the fiber layer, a method of jetting streams of water, and other related methods.

Nevertheless, the aforementioned methods are merely used for interlacing fibers, and not for adjusting the orientation and location of fibers in a fiber layer, shape of the fiber layer, or the like. In short, simple sheet-shaped nonwoven fabrics have been manufactured by means of these aforementioned methods.

As described above, there is a problem in that fiber orientation, location, and shape of nonwoven fabrics may not be easily adjusted in an ordinary nonwoven fabric manufacturing process. More specifically, there are problems in that it is difficult to adjust one or more of fiber orientation, fiber density, and basis weight of a fiber layer, and it is difficult to form one or more of groove portions, openings, and protrusions.

To solve the aforementioned problems, for example, a method of deforming a fiber web in the same irregular shape as that of a conveyer by arranging the fiber web containing thermoplastic fibers between a pair of breathable conveyers, which is a pair of breathable conveyers vertically arranged as viewed from a vertical direction, and the surface of at least one of the breathable conveyers is formed in an irregular shape, and directing air onto the surface of the fiber web while conveying the fiber web supported by the pair of breathable conveyers is disclosed in Japanese Unexamined Patent Application Publication No. Hei b 2-229255 (hereinafter referred to as Patent Document 1).

In the case of Patent Document 1, a fiber web is deformed in the same irregular shape as that of a conveyer by supporting the fiber web by way of a pair of breathable conveyers, with the surface of at least one of the breathable conveyers being formed in an irregular shape, and directing air onto one side of the supported fiber web.

In other words, in the nonwoven fabric manufacturing method (nonwoven fabric) according to Patent Document 1, there is a problem in that a pair of breathable conveyers, which supports a fiber web from above and below as viewed from a vertical direction, is needed in order to form a fiber web in an irregular shape. In addition, there is another problem in that the fiber web can only be formed in the same irregular shape as that of the conveyers. That is, there is a problem in that the fiber web may only be deformed into a specified irregular shape by way of the breathable conveyers formed in specified irregular shapes. Moreover, there is another problem in that it is difficult to adjust fiber orientation, fiber density, or basis weight. These are problems of the present invention.

SUMMARY OF THE INVENTION

To solve the above problems, the objective of the present invention is to provide a nonwoven fabric of which one or more of fiber orientation, fiber density, and basis weight can be adjusted, a manufacturing method for the same, and a nonwoven fabric manufacturing apparatus.

In addition, another objective of the present invention is to provide a nonwoven fabric in which one or more of the predetermined groove portions, openings, and protrusions are formed, a manufacturing method for the same, and a nonwoven fabric manufacturing apparatus.

In a first aspect of the present invention, a nonwoven fabric manufacturing apparatus comprising: a breathable supporting member that supports a fiber aggregate formed in a sheet shape from a first side of the fiber aggregate, and is in a state where at least a part of fibers constituting the fiber aggregate has a degree of freedom; a blowing device for blowing fluid mainly containing gas from a second side of the fiber aggregate supported from the first side by way of the breathable supporting member; and a conveying mechanism for conveying the fiber aggregate in a predetermined direction, wherein the conveying mechanism conveys the fiber aggregate, which is being supported from the first side by way of the breathable supporting member, in a first direction, and the blowing device blows the fluid mainly containing gas onto the second side of the fiber aggregate, which is being conveyed in the first direction by way of the conveying mechanism.

In a second aspect of the present invention, a nonwoven fabric manufacturing apparatus as described in the first aspect, the nonwoven fabric being adjusted at least one of fiber orientation, fiber density, basis weight, and forming at least one of a groove portion, an opening, and a protrusion.

In a third aspect of the nonwoven fabric manufacturing apparatus as described in the first or second aspect, the fluid mainly containing gas is a gas selected from: a gas having a temperature adjusted to room temperature or a predetermined temperature, and an aerosol which is a gas including solid or liquid particles.

In a fourth aspect of the nonwoven fabric manufacturing apparatus as described in any one of the first to third aspects, the fiber aggregate includes thermoplastic fibers that soften at a predetermined temperature, and a temperature of the fluid mainly containing gas to be blown by way of the blowing device onto the second side of the fiber aggregate is higher than the predetermined temperature at which the thermoplastic fibers soften.

In a fifth aspect of the nonwoven fabric manufacturing apparatus as described in any one of the first to fourth aspects, the breathable supporting member comprises: a permeable portion that allows the fluid mainly containing gas blown onto the fiber aggregate to pass through to the opposite side to the side on which the fiber aggregate is supported; and an impermeable portion that does not allow the fluid mainly containing gas blown onto the fiber aggregate to pass through to the opposite side, and does not allow fibers constituting the fiber aggregate to displace to the opposite side.

In a sixth aspect of the nonwoven fabric manufacturing apparatus as described in the fifth aspect, the permeable portion comprises at least one of: a first permeable portion that does not allow fibers constituting the fiber aggregate to substantially displace to the opposite side; and a second permeable portion that allows fibers constituting the fiber aggregate to displace to the opposite side.

In a seventh aspect of the nonwoven fabric manufacturing apparatus as described in any one of the first to fifth aspects, the breathable supporting member is one of a netted member, a member that is configured by placing the impermeable portion on the netted member through predetermined patterning, and a member that is configured by forming a plurality of predetermined holes in an impermeable flat member.

In an eighth aspect of the nonwoven fabric manufacturing apparatus as described in any one of the first to seventh aspects, a side of the breathable supporting member supporting the fiber aggregate has a shape selected from a planar shape and a curved shape, and the surface thereof being substantially flat.

In a ninth aspect of the nonwoven fabric manufacturing apparatus as described in any one of the first to eighth aspects, the breathable supporting member has a shape of a plate.

In a tenth aspect of the nonwoven fabric manufacturing apparatus as described in any one of the first to eighth aspects, the breathable supporting member has a cylindrical shape.

In an eleventh aspect of the nonwoven fabric manufacturing apparatus as described in any one of the first to tenth aspects, the breathable supporting member is disposed detachably on the nonwoven fabric manufacturing apparatus.

In a twelfth aspect of the nonwoven fabric manufacturing apparatus as described in any one of the first to eleventh aspects, the breathable supporting member is replaceable with another breathable supporting member selected from a plurality of different breathable supporting members.

In a thirteenth aspect of the present invention, the nonwoven fabric manufacturing apparatus as described in any one of the first to twelfth aspects further comprising: a conveyor controlling device for controlling the conveying mechanism, wherein the conveying mechanism comprises: a first conveying mechanism for conveying the fiber aggregate in a direction moving towards the blowing device; and a second conveying mechanism for conveying the fiber aggregate in a direction moving away from the blowing device, disposed in series with the first conveying mechanism, fiber aggregate, and the conveyor controlling device can adjust a first conveying rate of the fiber aggregate by way of the first conveying mechanism, and a second conveying rate of the fiber aggregate by way of the second conveying mechanism, respectively.

In a fourteenth aspect of the nonwoven fabric manufacturing apparatus as described in the thirteenth aspect, the conveyor controlling device can control the first conveying mechanism and the second conveying mechanism, so that the first conveying rate is faster than the second conveying rate.

In a fifteenth aspect of the nonwoven fabric manufacturing apparatus as described in any one of the first to fourteenth aspects, the blowing device comprising: an gas ejecting unit having a plurality of nozzles disposed at predetermined intervals along a direction intersecting the first direction so as to face the second side of the fiber aggregate; and a gas supply unit supplying one of the fluid mainly containing gas and gas constituting the fluid mainly containing gas to the gas ejecting unit.

In a sixteenth aspect of the nonwoven fabric manufacturing apparatus as described in any one of the first to fifteenth aspects, the blowing device continuously blows the fluid mainly containing gas onto the second side of the fiber aggregate.

In a seventeenth aspect of the nonwoven fabric manufacturing apparatus as described in any one of the first to sixteenth aspects, at least one of the fluid mainly containing gas to be blown by means of the blowing device, and the fluid mainly containing gas passing through the fiber aggregate and having changed flow direction by way of the impermeable portion displace fibers constituting the fiber aggregate.

In an eighteenth aspect of the present invention, a nonwoven fabric manufacturing method comprising steps of: supporting a fiber aggregate formed in a sheet shape from a first side by way of a breathable supporting member by disposing the fiber aggregate, which is in a state where at least a part of fibers constituting the fiber aggregate has a degree of freedom, on a predetermined side of the breathable supporting member, or stacking predetermined fibers on the predetermined side so as to form the fiber aggregate; conveying the fiber aggregate, which is supported by the breathable supporting member, by way of a predetermined conveying mechanism in a first direction; and blowing fluid mainly containing gas onto the fiber aggregate, which is conveyed in the first direction in the conveying step, from a second side which is not supported by the supporting member by way of a predetermined blowing device.

In a nineteenth aspect of the present invention, a nonwoven fabric manufacturing method as described in the eighteenth aspect, the nonwoven fabric being adjusted at least one of fiber orientation, fiber density, basis weight, and forming at least one of a groove portion, an opening, and a protrusion.

In a twentieth aspect of the nonwoven fabric manufacturing method as described in the eighteenth or nineteenth aspect, the fiber aggregate comprises thermoplastic fibers that soften at a predetermined temperature, and a temperature of the fluid mainly containing gas to be blown by way of the blowing device onto the second side of the fiber aggregate is higher than the predetermined temperature at which the thermoplastic fibers soften.

In a twenty-first aspect of the nonwoven fabric manufacturing method as described in any one of the eighteenth to twentieth aspects, the breathable supporting member in the supporting step comprises: a permeable portion that allows the fluid mainly containing gas blown onto the fiber aggregate to pass through to the opposite side to the side on which the fiber aggregate is supported; and an impermeable portion that does not allow the fluid mainly containing gas blown onto the fiber aggregate to pass through to the opposite side, and does not allow fibers constituting the fiber aggregate to displace to the opposite side.

In a twenty-second aspect of the nonwoven fabric manufacturing method as described in the twenty-first aspect, the permeable portion comprises at least one of: a first permeable portion that does not allow fibers constituting the fiber aggregate to substantially displace to the opposite side; and second permeable portion that allows fibers constituting the fiber aggregate to displace to the opposite side.

In a twenty-third aspect of the nonwoven fabric manufacturing method as described in any one of the eighteenth to the twenty-second aspects, the breathable supporting member in the supporting step is one of a netted member, a member configured by placing the impermeable portion on the netted member through predetermined patterning, and a member configured by forming a plurality of predetermined holes in an impermeable flat member.

In a twenty-fourth aspect of the nonwoven fabric manufacturing method as described in any one of the eighteenth to twenty-third aspects, a side of the breathable supporting member supporting the fiber aggregate in the supporting step has a shape selected from a planar shape and a curved shape, and a surface thereof being substantially flat.

In a twenty-fifth aspect of the nonwoven fabric manufacturing method as described in any one of the eighteenth to twenty-fourth aspects, the breathable supporting member in the supporting step has a shape of a plate.

In a twenty-sixth aspect of the nonwoven fabric manufacturing method as described in any one of the eighteenth to twenty-fourth aspects, the breathable supporting member in the supporting step has a cylindrical shape.

In a twenty-seventh aspect of the nonwoven fabric manufacturing method as described in any one of the eighteenth to twenty-sixth aspects, the breathable supporting member in the supporting step is selected from a plurality of different breathable supporting members.

In a twenty-eighth aspect of the nonwoven fabric manufacturing method as described in any one of the eighteenth to twenty-seventh aspects, the conveying step comprises: a first conveying step of conveying the fiber aggregate in a direction moving towards the blowing device; and a second conveying step subsequent to the first conveying step of conveying the fiber aggregate in a direction moving away from the blowing device, wherein a first conveying rate, which is a conveying rate of the fiber aggregate in the first conveying step, is faster than a second conveying rate, which is a conveying rate of the fiber aggregate in the second conveying step.

In a twenty-ninth aspect of the nonwoven fabric manufacturing method as described in any one of the eighteenth to twenty-eighth aspects, the blowing device in the blowing step comprises a gas ejecting unit having a plurality of nozzles disposed at predetermined intervals along a direction intersecting with the first direction so as to face the second side of the fiber aggregate, wherein the fluid mainly containing gas ejected from the plurality of respective nozzles is blown onto the second side of the fiber aggregate.

In a thirtieth aspect of the nonwoven fabric manufacturing method as described in the twenty-first or twenty-second aspect, a predetermined groove portion during the blowing step is formed by blowing the fluid mainly containing gas onto a region that is supported by the permeable portion of the breathable supporting member of the fiber aggregate.

In a thirty-first aspect of the nonwoven fabric manufacturing method as described in the twenty-first or twenty-second aspect, a predetermined opening is formed during the blowing step by blowing the fluid mainly containing gas onto a region that is supported by the impermeable portion of the breathable supporting member of the fiber aggregate.

In a thirty-second aspect of the nonwoven fabric manufacturing method as described in the twenty-second aspect, a predetermined protrusion is formed during the blowing step by displacing fibers constituting the fiber aggregate so as to enter the second permeable portion by blowing the fluid mainly containing gas onto a region that is supported by the second permeable portion of the breathable supporting member of the fiber aggregate.

In a thirty-third aspect of the nonwoven fabric manufacturing method as described in any one of the eighteenth to thirty-second aspects, the fluid mainly containing gas is continuously blown onto the second side of the fiber aggregate during the blowing step.

In a thirty-fourth aspect of the nonwoven fabric manufacturing method as described in any one of the eighteenth to thirty-second aspects, in the blowing step, at least one of: the fluid mainly containing gas, and the fluid mainly containing gas passing through the fiber aggregate and having changed flow direction by way of the impermeable portion, displace the fibers constituting the fiber aggregate.

In a thirty-fifth aspect of the present invention, a nonwoven fabric which is a nonwoven fabric of which a predefined conformation is adjusted by blowing fluid mainly containing gas onto a fiber aggregate, which is formed in a sheet shape and supported from a first side by way of a predetermined breathable supporting member, and which is in a state where at least a part of fibers constituting the fiber aggregate has a degree of freedom.

In a thirty-sixth aspect of the nonwoven fabric as described in the thirty-fifth aspect, the nonwoven fabric being adjusted at least one of fiber orientation, fiber density, basis weight, and forming at least one of a groove portion, an opening, and a protrusion.

In a thirty-seventh aspect of the nonwoven fabric as described in the thirty-fifth or thirty-sixth aspect, the fiber aggregate includes thermoplastic fibers that soften at a predetermined temperature, a temperature of the fluid mainly containing gas to be blown by way of the blowing device onto a second side of the fiber aggregate is higher than the predetermined temperature at which the thermoplastic fibers soften, and at least a part of the thermoplastic fibers contacted by the fluid mainly containing gas are softened or melted, and at least one of adjusted fiber orientation, fiber density, and basis weight are maintained.

In a thirty-eighth aspect of the nonwoven fabric as o described in any one of the thirty-fifth to thirty-seventh aspects, the breathable supporting member comprises: a permeable portion that allows the fluid mainly containing gas blown onto the fiber aggregate to pass through to the opposite side to the side on which the fiber aggregate is supported; and an impermeable portion that does not allow the fluid mainly containing gas blown onto the fiber aggregate to pass through to the opposite side, and does not allow fibers constituting the fiber aggregate to displace to the opposite side, wherein at least one of fiber orientation, fiber density, and basis weight is adjusted according to a shape and arrangement of the permeable portion and the impermeable portion.

In a thirty-ninth aspect of the nonwoven fabric as described in any one of the thirty-fifth to thirty-eighth aspects, the fluid mainly containing gas, and the fluid mainly containing gas passing through the fiber aggregate and having changed flow direction by way of the impermeable portion displace fibers constituting the fiber aggregate to adjust at least one of fiber orientation, fiber density, and basis weight.

In a fortieth aspect of the nonwoven fabric as described in the thirty-fifth or thirty-sixth aspect, the fiber aggregate includes thermoplastic fibers that soften at a predetermined temperature, a temperature of the fluid mainly containing gas to be blown by way of the blowing device onto a second side of the fiber aggregate is higher than the predetermined temperature at which the thermoplastic fibers soften, and at least a part of the thermoplastic fibers contacted by the fluid mainly containing gas is softened or melted, and the shape of at least one of formed predetermined groove portion, opening, and protrusion is maintained.

In a forty-first aspect of the nonwoven fabric as described in any one of the thirty-fifth, thirty-sixth, and fortieth aspects, includes a permeable portion that allows the fluid mainly containing gas blown onto the fiber aggregate to pass through to the opposite side to the side on which the fiber aggregate is supported; and an impermeable portion that does not allow the fluid mainly containing gas blown onto the fiber aggregate to pass through to the opposite side, and does not allow fibers constituting the fiber aggregate to displace to the opposite side, wherein at least one of a predetermined groove portion, an opening, and a protrusion is formed according to a shape and arrangement of the permeable portion and the impermeable portion.

In a forty-second aspect of present invention, the nonwoven fabric as described in the forty-first aspect, a predetermined groove portion is formed by blowing the fluid mainly containing gas onto a region supported by the permeable portion of the breathable supporting member of the fiber aggregate.

In a forty-third aspect of the nonwoven fabric as described in the forty-first aspect, a predetermined opening is formed by blowing the fluid mainly containing gas onto a region supported by the impermeable portion of the breathable supporting member of the fiber aggregate.

In a forty-forth aspect of the nonwoven fabric as described in the forty-first aspect, the permeable portion is a hole, and a predetermined protrusion is formed by displacing fibers constituting the fiber aggregate so as to enter the hole by blowing the fluid mainly containing gas onto a region supported by the impermeable portion of the breathable supporting member of the fiber aggregate.

In a forty-fifth aspect of the nonwoven fabric as described in the thirty-second aspects, at least one of: the fluid mainly containing gas to be blown, and the fluid mainly containing gas passing through the fiber aggregate and having changed flow direction by way of the impermeable portion displace fibers constituting the fiber aggregate to form at least one of a predetermined groove portion, an opening, and a protrusion.

The present invention can provide a nonwoven fabric of which at least one of fiber orientation, fiber density, and basis weight is adjusted, a manufacturing method for the nonwoven fabric, and a nonwoven fabric manufacturing apparatus.

In addition, the present invention can also provide a nonwoven fabric in which one or more of predetermined groove portions, openings, and protrusions are formed, a manufacturing method for the nonwoven fabric, and a nonwoven fabric manufacturing apparatus.

DETAILED DESCRIPTION OF THE INVENTION

Figure 1:
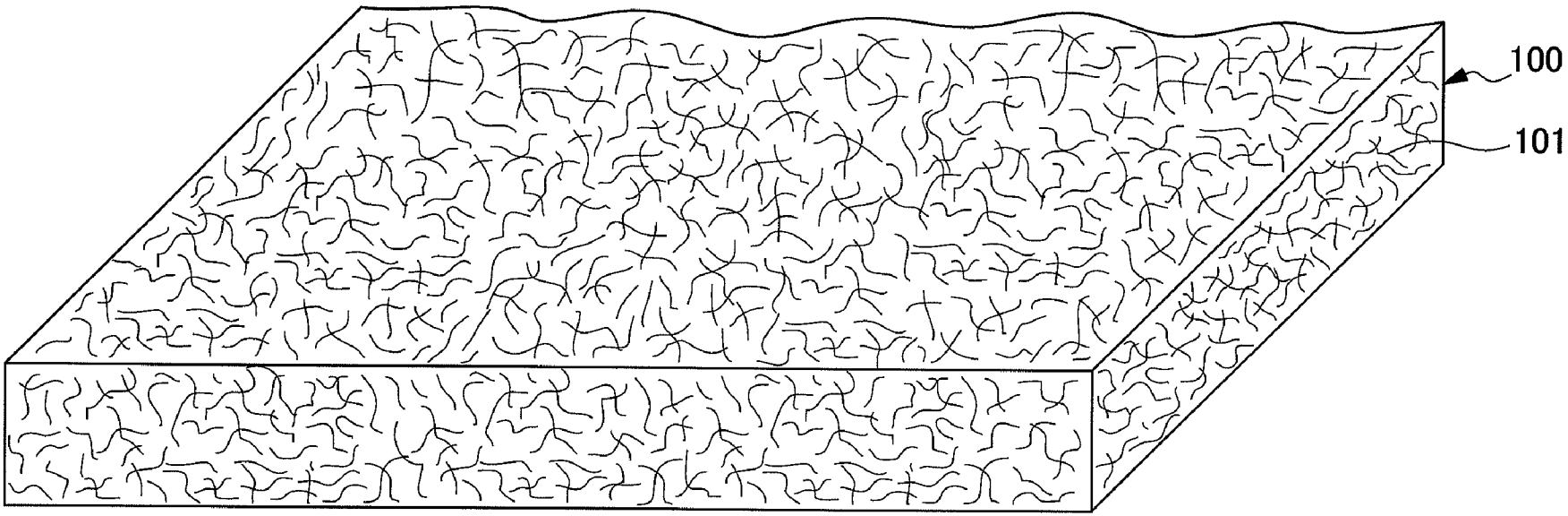
FIG. 1 is a perspective view of a fiber web.

Preferred embodiments of the present invention are described below while referring to the drawings.

1. Overview 1-1. Nonwoven Fabric Manufacturing Apparatus

A nonwoven fabric manufacturing apparatus of the present invention manufactures a nonwoven fabric of which one or more of a fiber orientation, fiber density, and basis weight is adjusted by blowing fluid mainly containing gas onto a fiber aggregate which is formed in a sheet shape, and which is in a state where at least a part of the fibers constituting the fiber aggregate has a degree of freedom. In the present invention, the state where fibers have a degree of freedom means a state where at least one of a position and an orientation of fibers are changeable. The state where at least a position and an orientation of fibers are changeable is preferable as the state where fibers have a degree of freedom when the fluid mainly containing gas is blown thereupon. In other words, it is in a state where fibers have a degree of freedom.

In addition, the nonwoven fabric manufacturing apparatus of the present invention manufactures a nonwoven fabric in which one or more of predetermined groove portions, openings, and protrusions are formed by blowing fluid mainly containing gas onto a fiber aggregate which is formed in a sheet shape, and is in a state where at least a part of the fibers constituting the fiber aggregate has a degree of freedom.

Figure 14:
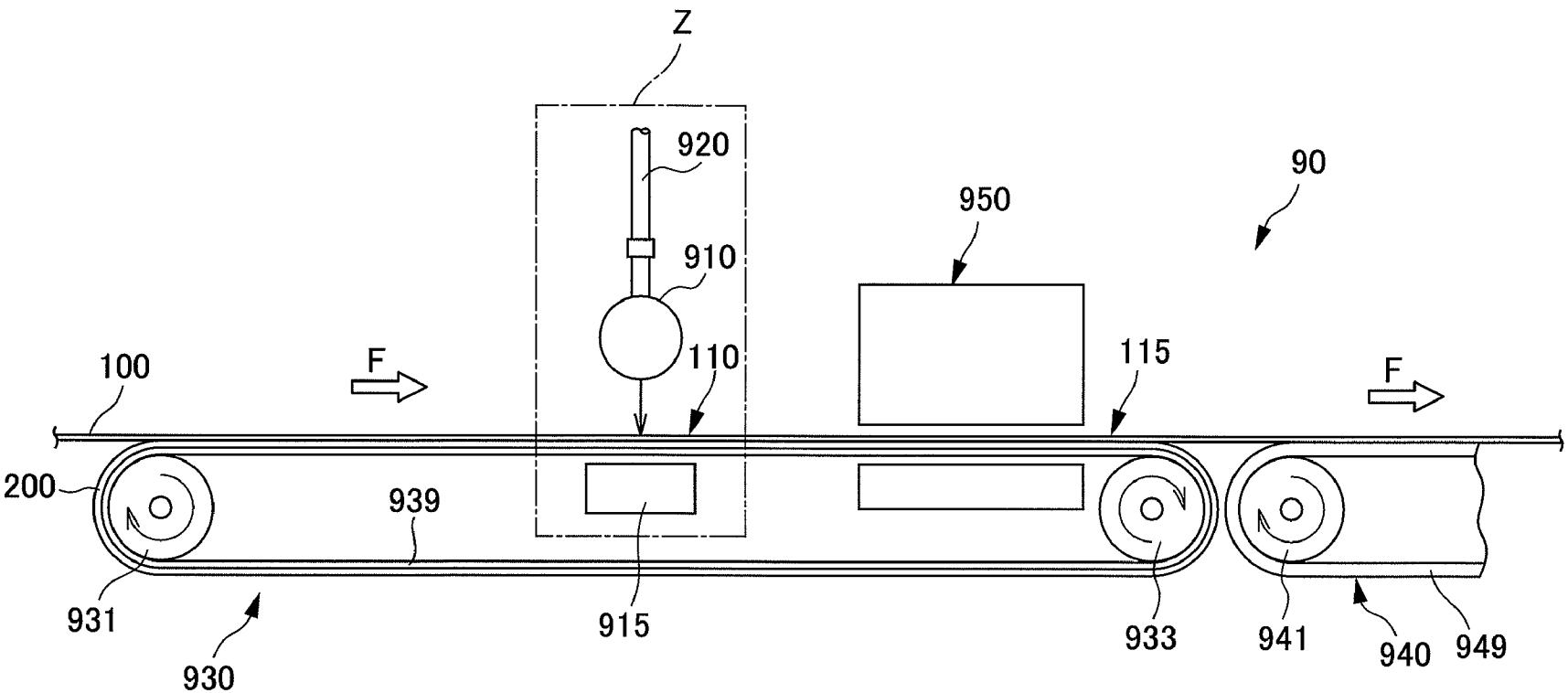
FIG. 14 is a lateral view illustrating a nonwoven fabric manufacturing apparatus of the first embodiment.

More specifically, as illustrated in FIG. 14, a nonwoven fabric manufacturing apparatus 90 of the present invention is configured with a breathable supporting member 200, which supports a fiber web 100 or a fiber aggregate from a first side, an gas ejecting unit 910 and an gas supplying unit not shown in the drawing, which are a blowing device to blow a fluid mainly containing gas from a second side of the fiber web 100 onto the fiber web 100 supported by the breathable supporting member 200 from the first side, and a conveyer 930, which is a conveying mechanism for conveying the fiber web 100 in a predetermined direction F.

In addition, the conveyer 930 displaces the fiber web 100, which is being supported by the breathable supporting member 200 from the one side, in the predetermined direction F, and the gas ejecting unit 910 and the gas supplying unit, not shown in the drawing, blow a fluid mainly containing gas onto a second side of the fiber web 100, which is displaced by way of the conveyer 930 in the predetermined direction F.

1-2. Nonwoven Fabric Manufacturing Method

A nonwoven fabric manufacturing method of the present invention is a method of manufacturing a nonwoven fabric in which one or more of a fiber orientation, fiber density, and basis weight is adjusted by directing a jet of fluid mainly containing gas onto a fiber aggregate which is formed in a sheet shape, and is in a state where at least a part of the fibers constituting the fiber aggregate has a degree of freedom.

In addition, the nonwoven fabric manufacturing method of the present invention is a method of manufacturing a nonwoven fabric in which one or more of predetermined groove portions, openings, and protrusions are formed by directing a jet of fluid mainly containing gas onto a fiber aggregate which is formed in a sheet shape, and which is in a state where at least a part of the fibers constituting the fiber aggregate has a degree of freedom.

More specifically, as illustrated in FIG. 14, the nonwoven fabric manufacturing method of the present invention includes a supporting step of supporting the fiber web 100 or a fiber aggregate by the breathable supporting member 200 from a first side by arranging the fiber web 100 on a predetermined side of the breathable supporting member 200 or by stacking and arranging predetermined fibers on a predetermined side so as to form the fiber web 100 or the fiber aggregate, a displacing step of displacing the fiber web 100, which is supported by the breathable supporting member 200, by way of the conveyer 930 in a predetermined direction F, and a blowing step of directing a jet of fluid mainly containing gas from a second side onto the fiber web 100, which is displaced in the displacing step by way of the gas ejecting unit 910, and the gas supplying unit, not shown in the drawing, in the predetermined direction F.

1-3. Nonwoven Fabric

The nonwoven fabric of the present invention is a nonwoven fabric of which one or more of a fiber orientation, fiber density, and basis weight is adjusted by blowing a fluid mainly containing gas onto a fiber aggregate which is formed in a sheet shape, and supported from a first side by a predetermined breathable supporting member, and which is in a state where at least a part of the fibers constituting the fiber aggregate has a degree of freedom.

In addition, the nonwoven fabric of the present invention is a nonwoven fabric in which one or more of predetermined groove portions, openings, and protrusions are formed by directing a jet of fluid mainly containing gas onto a fiber aggregate which is formed in a sheet shape and supported from the first side by a predetermined breathable supporting member, and is in a state where at least a part of the fibers constituting the fiber aggregate has a degree of freedom.

2. Fiber Aggregate

As mentioned above, the nonwoven fabric of the present invention may be provided by adjusting fiber orientation, fiber density, or basis weight, or by forming predetermined groove portions, openings, or protrusions by blowing a fluid mainly containing gas onto a fiber aggregate formed in a sheet shape such as the fiber web 100, as shown in FIG. 1, in the state where at least a part of the fibers has a degree of freedom.

The fiber aggregate is formed in a sheet shape and is in a state where at least a part of the fibers constituting the fiber aggregate has a degree of freedom. In other words, at least a part of the fibers constituting the fiber aggregate is in a free state. In addition, at least a part of the fibers constituting the fiber aggregate are in a state where the relative positioning is changeable. The fiber aggregate may be formed by ejecting mixed fibers of a plurality of fibers mixed so as to form fiber layers of a predetermined thickness. Moreover, it may be formed by ejecting a plurality of different fibers, respectively, so as to form fiber layers by stacking several times.

A fiber web formed by a carding method or fiber web before solidification of heat-sealed fibers may be exemplified as the fiber aggregate of the present invention. In addition, a web formed by an air-laid method or fiber web before solidification of heat-sealed fibers may be exemplified. Moreover, a fiber web embossed by a point bond method before solidification by heat-sealing may also be exemplified. Furthermore, a fiber aggregate subjected to fiber formation by a spun-bond method before embossing, or embossed fiber aggregate before solidification by heat-sealing may be exemplified. In addition, a fiber web which is formed and semi-interlaced by a needle-punch method may also be exemplified. Moreover, a fiber web which is formed and semi-interlaced by a spun-lace method may also be exemplified. Furthermore, a fiber web subjected to fiber formation by a melt-blown method before inter-fiber solidification by heat-sealing may also be exemplified. Furthermore, a fiber web formed by a solvent bonding method before inter-fiber solidification by a solvent may be exemplified.

A fiber aggregate with fibers easily realigned by air (gas) flow may be exemplified preferably as a fiber web formed by a carding method using relatively long fibers, and more preferably as a web before heat-sealing in a state where fibers are easily displaced and formed only by interlacing. In addition, it is preferable to use a through-air method which heat-seals the thermoplastic fibers included in the fiber aggregate through oven processing (heat processing) using a predetermined heater or the like to make a nonwoven fabric, while maintaining the shape after groove portions (concavity and convexity) and the like are formed by a plurality of air (gas) flows, which are described below.

3. Fibers

A thermoplastic resin such as low-density polyethylene, high-density polyethylene, linear polyethylene, polypropylene, polyethylene terephthalate, modified polyethylene, modified polyethylene terephthalate, nylon, polyamide, and the like, or each respective resin by itself or compound fibers thereof may be given as the fibers constituting the fiber aggregate (e.g., fibers 101 constituting the fiber web 100 shown in FIG. 1).

Core-sheath type having a higher melting point for core components than sheath components, core-sheath bias-core type, and side-by-side type having different melting points for left and right components may be given as compound shapes. Moreover, a hollow type, or an atypical shape such as flat, Y type, and C type, three-dimensional crimped fibers that are potentially crimped or overtly crimped, or split fibers which are split due to physical load such as water flow, heat, or embossing may be mixed.

In addition, it is possible to compound predetermined overtly crimped fibers or potentially crimped fibers for forming a three-dimensional crimped shape. In this case, a spiral shape, a zigzag shape, or an ohm-symbol shape (Ω shape) may be exemplified as a three-dimensional crimped shape, and while the fiber orientation is in a planar direction on the whole, fibers are partially oriented in the thickness direction. This makes the buckling strength of fibers themselves work in the thickness direction, and thus it becomes difficult for the bulk to be crushed, even if an external pressure is applied. Moreover, of these shapes, if the fibers are of a spiral shape, it attempts to return to the original shape when external pressure is released, and thus, even if the bulk is somewhat compressed due to excessive external pressure, it becomes easy to return to the original thickness after the external pressure is released.

Overtly crimped fiber is a generic term for fibers having a shape imparted through mechanical crimping or having core-sheath structure being of biased core type or which have already been crimped by a side-by-side method, or the like. Potentially crimped fibers are those in which crimps are generated through heating.

Mechanical crimping allows for control of the generation of crimps in continuously linear spun fibers after fiber formation by way of a difference in the peripheral velocity of line speed in the machine direction, heat, and the application of force. The more crimps that are present in each unit length, the larger the increase in buckling strength against external pressure. For example, it is preferable that the number of crimps in each unit fiber length is within a range from 10 to 35/inch, and more preferably 15 to 30/inch.

Fibers made of more than two resins having different melting points may be exemplified as fibers crimped by thermal shrinkage. Such fibers are three-dimensionally crimped due to a difference in rate of thermal contraction when heated. Bias-core type of a core-sheath structure having core that is arranged apart from the center and side-by-side type and having different melting points for left and right components may be exemplified as the resin structure of thermal crimped fibers. The rate of thermal contraction of such fibers ranges preferably from 5 to 90%, and more preferably 10 to 80%.

A method of measuring thermal shrinkage rate includes steps of (1) forming a fiber web of 200 g/m$^2$ with 100% of the fibers to be measured, (2) cutting the fiber web into a 250×250 mm sample, (3) leaving the sample for five minutes in an oven at 145 degrees centigrade (418.15K), (4) measuring the length of the sample after thermal shrinkage, and (5) then calculating a thermal shrinkage rate from the difference in length before and after thermal shrinkage.

If the nonwoven fabric is used as a surface sheet, it is preferable that the fineness ranges be of 1.1 to 8.8 dtex when considering intrusion of fluid and the feel, for example.

If the nonwoven fabric is used as a surface sheet, cellulosic liquid hydrophilic fibers such as pulp, chemical pulp, rayon, acetate, and natural cotton, may be included as fibers constituting the fiber aggregate to also absorb a small amount of menstrual blood, sweat, and the like remaining on the skin, for example. However, cellulosic fibers are difficult to eject once fluid is absorbed, and thus a case of mixing in a range of 0.1 to 5% by mass of the overall mass may be exemplified as a preferred form.

If the nonwoven fabric is used as a surface sheet, a hydrophilic agent, a water-repellent agent, or the like may be milled in or coated onto the abovementioned hydrophobic synthetic fibers in view of intrusion of fluid and a rewet back. In addition, fibers to which a hydrophilic property is imparted through a corona treatment or a plasma treatment may be used.

In addition, inorganic filler such as titanium oxide, barium sulfate, or calcium carbonate, for example, may be included in order to increase the whitening property. In the case of core-sheath type compound fibers, inorganic filler may be included in only cores, or also in sheaths.

In addition, as mentioned above, a fiber web formed by a carding method which uses relatively long fibers allows for easy realignment of fibers by stream of air. It is preferable that a through-air method which heat-seals thermoplastic fibers by way of an oven treatment (heat treatment) is used to maintain the shape after groove portions (concavity and convexity) and the like are formed by a plurality of air (gas) flows. It is preferable that fibers of core-sheath structure or side-by-side structure, which allows for heat-sealing at the intersecting points of fibers, be used as fibers suitable for this manufacturing method, and it is even further preferable that fibers of core-sheath structure, which allows absolute heat-sealing of cores, be used. In particular, it is preferable that core-sheath compound fibers constituted with polyethylene terephthalate and polyethylene, or core-sheath compound fibers constituted with polypropylene and polyethylene be used. The nonwoven fabric (fiber web) may be constituted with only one type, or a combination of two or more types of the abovementioned fibers. Moreover, the lengths of the fibers constituting the nonwoven fabric (fiber web) are from 20 to 100 mm, and preferably 35 to 65 mm.

4. Fluid Mainly Containing Gas

A gas adjusted to room temperature or a predetermined temperature, or an aerosol which is a gas including solid or liquid particles, may be exemplified as the fluid mainly containing gas of the present invention.

Air, nitrogen, or the like, for example, may be exemplified as the gas. In addition, the gas includes liquid vapor such as water vapor.

An aerosol is a gas within which a fluid or solid is dispersed. Examples are given below. It is possible to exemplify a gas within which is dispersed an ink for coloring, a softening agent such as silicon for enhancing suppleness, a hydrophilic or water-repellent activator for preventing electrostatic charge and controlling the wetting property, inorganic filler such as titanium oxide and barium sulfate for increasing fluidic energy, a powder bond such as polyethylene for increasing fluidic energy and enhancing irregular form-maintaining property during heat treatment, an antihistamic agent such as diphenhydramine hydrochloride or isopropyl-methylphenol for preventing itching, a humectant, and a disinfectant, or the like. In this case, the solid includes gelatinous ones.

The temperature of the fluid mainly containing gas may be adjusted as needed. Fiber orientation, fiber density, or basis weight of a nonwoven fabric to be manufactured, or shapes of groove portions, openings, or protrusions to be formed may be adjusted as needed according to the properties of the fibers constituting a fiber aggregate.

In this case, to favorably displace fibers constituting a fiber aggregate, the temperature of the fluid mainly containing gas is preferably relatively high since the fibers constituting the fiber aggregate may be easily displaced or deformed. In addition, if thermoplastic fibers are included in the fiber aggregate, it is possible to construct the fiber aggregate such that the thermoplastic fibers placed on regions or the like onto which fluid mainly containing gas is blown are softened or melted, and hardened again by setting the temperature of the fluid mainly containing gas to a temperature that allows softening of the thermoplastic fibers. In particular, if the temperature of the fluid mainly containing gas is higher than the melting point of the fibers, fibers are displaced, and the displaced fibers are heat-sealed at the intersecting points.

This maintains the shape of the nonwoven fabric after fiber orientation, fiber density, or basis weight is adjusted or groove portions, openings, or protrusions are formed by directing the fluid mainly containing gas thereupon, for example. In addition, a certain amount of strength is provided to prevent a fiber aggregate (nonwoven fabric) from coming apart when the fiber aggregate is displaced by way of a predetermined displacing means, for example.

The flow rate of fluid mainly containing gas may be adjusted as needed according to fiber orientation, fiber density, or basis weight to be adjusted, or shapes of groove portions, openings, or protrusions to be formed. A fiber web 100, which is mainly constituted with core-sheath fibers having a sheath made of high-density polyethylene and a core made of polyethylene terephthalate, fiber length of 20 to 100 mm, preferably 35 to 65 mm, fineness of 1.1 to 8.8 dtex, preferably 2.2 to 5.6 dtex, uses fibers with fiber length of 20 to 100 mm, preferably 35 to 65 mm in the case of opening by a carding method, uses fibers with fiber length of 1 to 5 mm, preferably 3 to 20 mm in the case of opening by an air-laid method, and is adjusted so as to be 10 to 1000 g/m$^2$, preferably 15 to 100 g/m$^2$, may be exemplified as a concrete example of a fiber aggregate. A case where hot air at a temperature of 15 to 300 degrees centigrade (from 288.15K to 573.15K), preferably 100 to 200 degrees centigrade (from 373.15K to 473.15K), is blown onto the fiber web 100 under the conditions of air volume of 3 to 50 [L/minute per opening], preferably 5 to 20 [L/minute per opening] in an gas ejecting unit 910 in which a plurality of nozzles 913, shown in FIG. 16 or FIG. 17, for example, is formed (nozzles 913: diameter of 0.1 to 30 mm, preferably 0.3 to 10 mm; pitch of 0.5 to 30 mm, preferably 0 to 1 mm; shape of a substantially circle, an ellipse, or a rectangle) may be exemplified as conditions for the fluid mainly containing gas. For example, if the fluid mainly containing gas is blown upon a fiber aggregate under the aforementioned conditions, a fiber aggregate which allows the fiber components to change their position and orientation is one of the favorable fiber assemblies of the present invention. It is possible to provide the nonwoven fabric shown in FIGS. 2 and 3 by manufacturing under the aforementioned manufacturing conditions using such fibers. It is preferable that the dimensions and basis weight of the groove portions 1 and raised ridge portions 2 fall within the following ranges. In the case of the groove portions 1, the thickness is within a range of 0.05 to 10 mm, preferably 0.1 to 5 mm, the width is within a range of 0.1 to 30 mm, preferably 0.5 to 5 mm, and basis weight is within a range of 2 to 900 g/m$^2$, preferably 10 to 90 g/m$^2$. In the case of the raised ridge portions 2, the thickness is within a range of 0.1 to 15 mm, preferably 0.5 to 10 mm, the width is within a range of 0.5 to 30 mm, preferably 1.0 to 10 mm, and basis weight is within a range of 5 to 1000 g/m$^2$, preferably 10 to 100 g/m$^2$. A nonwoven fabric may be manufactured substantially within the abovementioned numerical ranges; however, it is not limited thereto.

5. Nonwoven Fabric Manufacturing Apparatus

A nonwoven fabric manufacturing apparatus of the present invention is described below while referring to FIGS. 14 through 19.

5-1. Nonwoven Fabric Manufacturing Apparatus of First Embodiment

A nonwoven fabric manufacturing apparatus according to a first embodiment of the present invention is described below while referring to FIGS. 14 through 17.

5-1-1. Overall Structure

Figure 15:
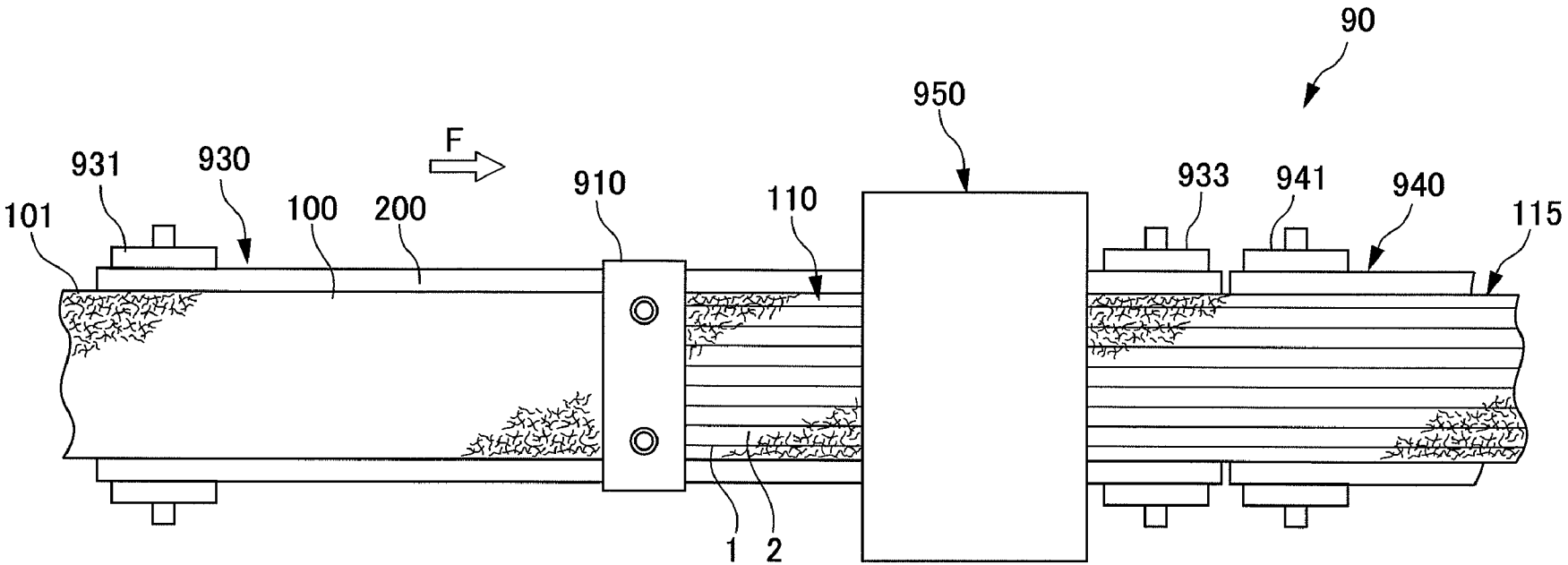
FIG. 15 is a plan view illustrating the nonwoven fabric manufacturing apparatus of FIG. 14.

As illustrated in FIG. 14 or 15, a nonwoven fabric manufacturing apparatus 90 of the present invention manufactures a nonwoven fabric of which at least one of fiber orientation, fiber density, and basis weight is adjusted by directing a jet of fluid mainly containing gas onto a fiber aggregate which is formed in a sheet shape, and which is in a state where at least a part of the fibers constituting the fiber aggregate has a degree of freedom.

In addition, the nonwoven fabric manufacturing apparatus 90 of the present invention manufactures a nonwoven fabric in which at least one of predetermined groove portions, openings, and protrusions is formed by directing a jet of fluid mainly containing gas onto a fiber aggregate which is formed in a sheet shape, and which is in a state where at least a part of the fibers constituting the fiber aggregate has a degree of freedom.

The nonwoven fabric manufacturing apparatus 90 is configured with a breathable supporting member 200, which supports a fiber web 100 or fiber aggregate from a first side, an gas ejecting unit 910 and an gas supplying unit not shown in the drawing, which are a blowing device to blow a fluid mainly containing gas from a second side of the fiber web 100 onto the fiber web 100 supported by the breathable supporting member 200 from the first side, and a conveyer 930, which is a displacing means to displace the fiber web 100 in a predetermined direction F.

In addition, the conveyer 930 displaces the fiber web 100, which is supported by the breathable supporting member 200 from the first side, in the predetermined direction F, and the gas ejecting unit 910 and the gas supplying unit, not shown in the drawing, blow a fluid mainly containing gas onto the second side of the fiber web 100, which is conveyed in the predetermined direction F by the conveyer 930.

Accordingly, positions and/or orientations of the fibers 101 constituting the fiber web 100 are changed by the fluid mainly containing gas, which is ejected (blown) from the gas ejecting unit 910, and/or fluid mainly containing gas that has passed through the fiber web 100 having changed flow direction by way of a breathable supporting member, as described later. Fiber orientation, fiber density, or basis weight of the fiber web 100 may be adjusted, and groove portions, openings, or protrusions of predetermined shapes may be formed by adjusting the degree of change in positions and/or orientations of the fibers 101.

Here, shapes and locations of permeable portions and impermeable portions in a breathable supporting member are designed according to a desired fiber orientation, fiber density, or basis weight, or desired shapes of groove portions, openings, or protrusions. In other words, it is possible to manufacture a nonwoven fabric with a desired fiber orientation, fiber density, or basis weight, or desired shapes of groove portions, openings, or protrusions by adjusting the shapes and locations of permeable portions and impermeable portions in a breathable supporting member.

In addition, it is possible to adjust a degree of change (e.g., displacement) in positions and/or orientations of the fibers 101 constituting the fiber web 100 by changing the blowing conditions for the fluid mainly containing gas, even if the same breathable supporting member is used. In other words, it is possible to adjust fiber orientation, fiber density, or basis weight, or the shapes of groove portions, openings, or protrusions of a nonwoven fabric by adjusting the blowing conditions for the fluid mainly containing gas in addition to the shapes and locations of permeable portions and impermeable portions in a breathable supporting member.

In short, the nonwoven fabric manufacturing apparatus 90 of the present invention allows for manufacturing of a nonwoven fabric with a desirably adjusted fiber orientation, fiber density, or basis weight, or desirably formed groove portions, openings, or protrusions by adjusting the blowing conditions for the fluid mainly containing gas in addition to selecting a predetermined breathable supporting member from a plurality of different breathable supporting members.

5-1-2. Components 5-1-2-1. Breathable Supporting Member

The breathable supporting member 200 is, for example, a supporting member which allows the fluid mainly containing gas passed through the fiber web 100 or fluid mainly containing gas ejected from the gas ejecting unit 910 in FIG. 14 to pass through to the opposite side to the side on which the fiber web 100 is placed.

Figure 4A:
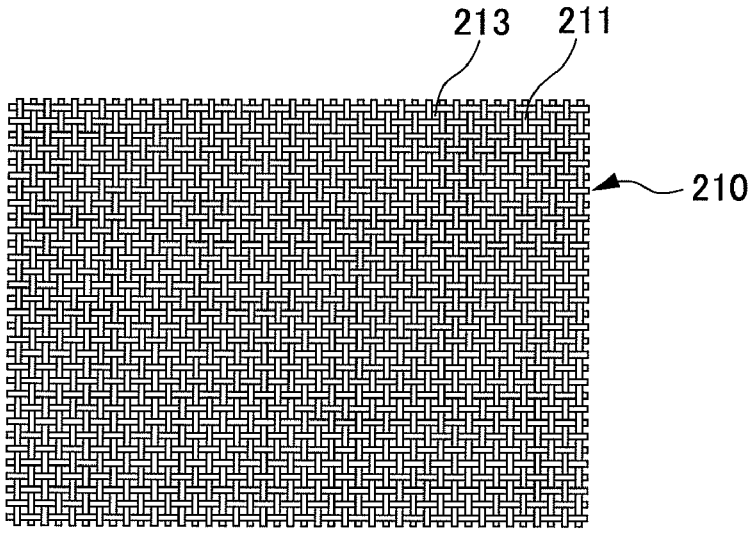
FIG. 4A is a plan view of a netted supporting member.
Figure 4B:
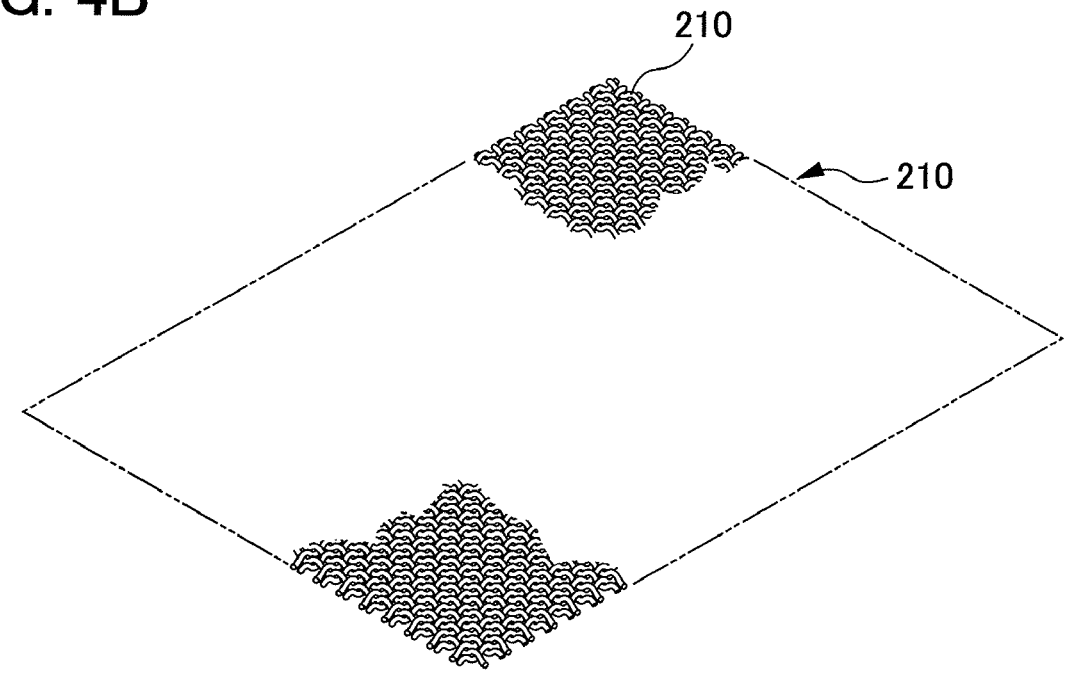
FIG. 4B is a perspective view of a netted supporting member.
Figure 5:
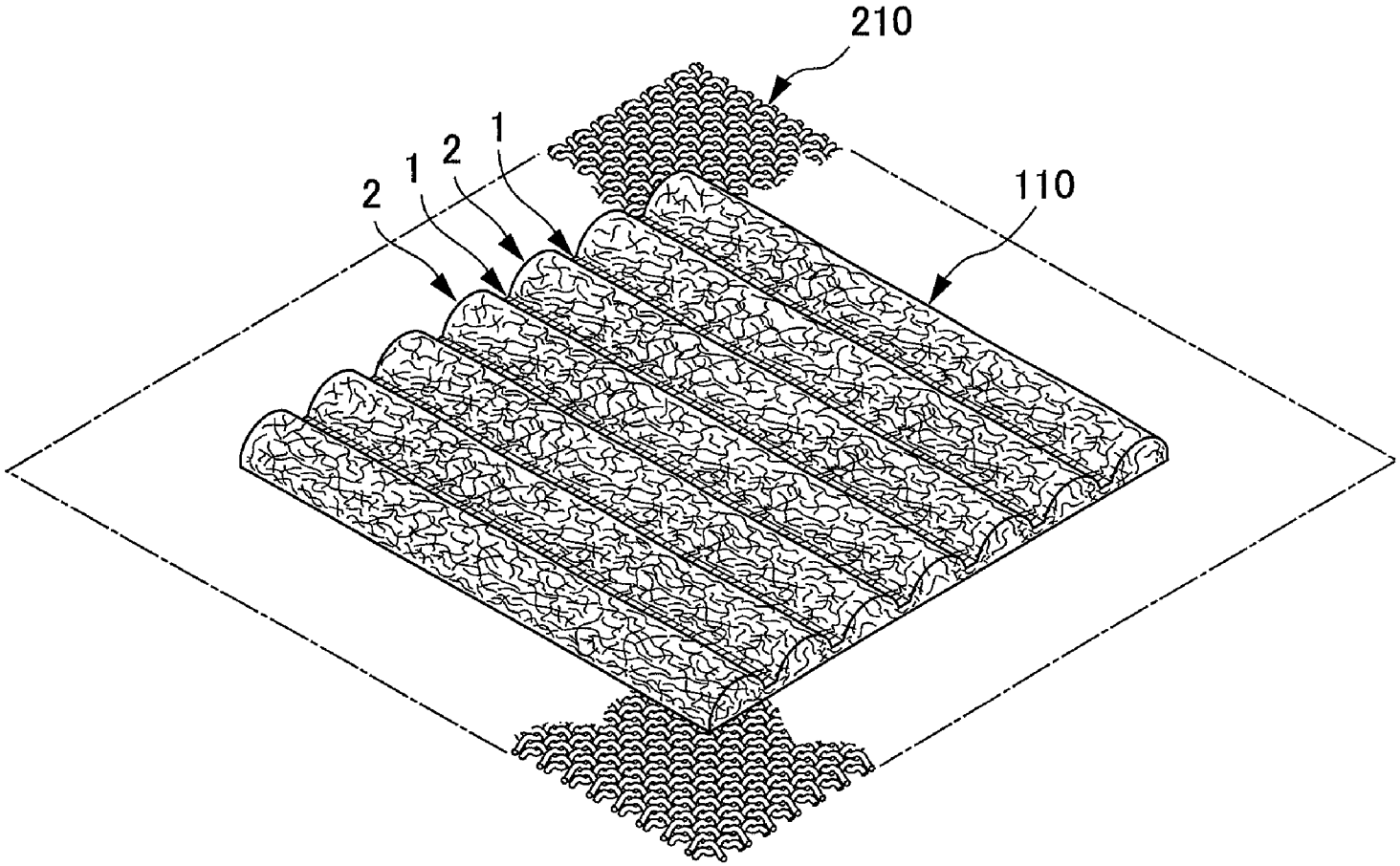
FIG. 5 is a diagram illustrating the nonwoven fabric of the first embodiment in FIG. 2A being manufactured by blowing a gas onto the topside of the fiber web of FIG. 1, while the underside is supported by the netted supporting member of FIG. 4B.
Figure 6A:
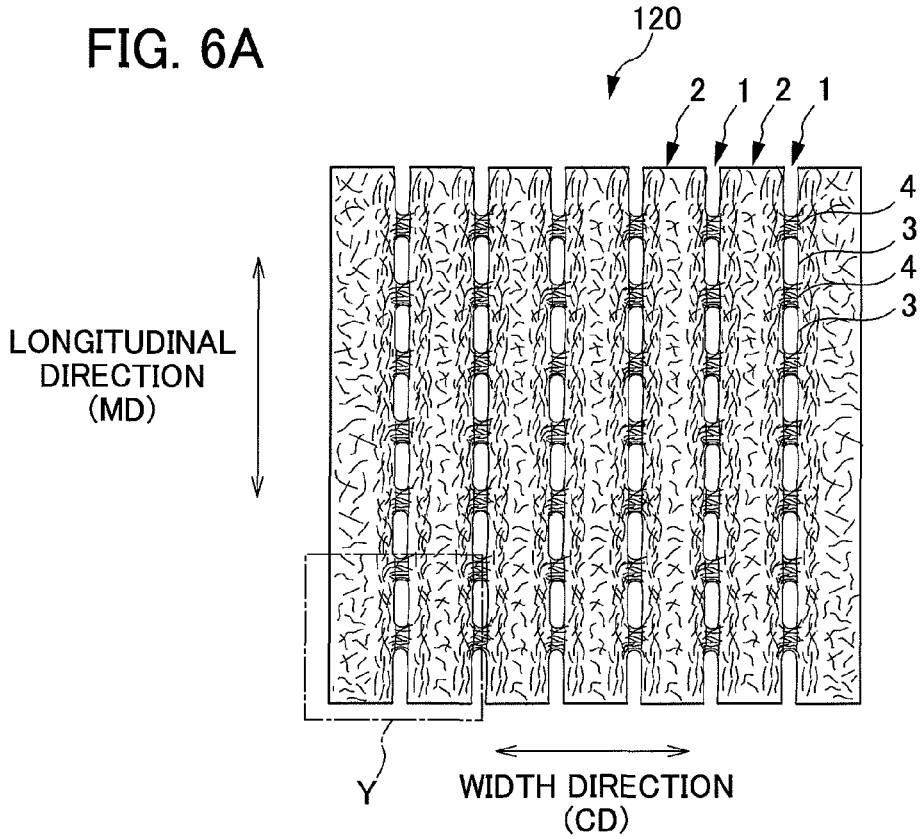
FIG. 6A is a plan view of a nonwoven fabric of a second embodiment.
Figure 6B:
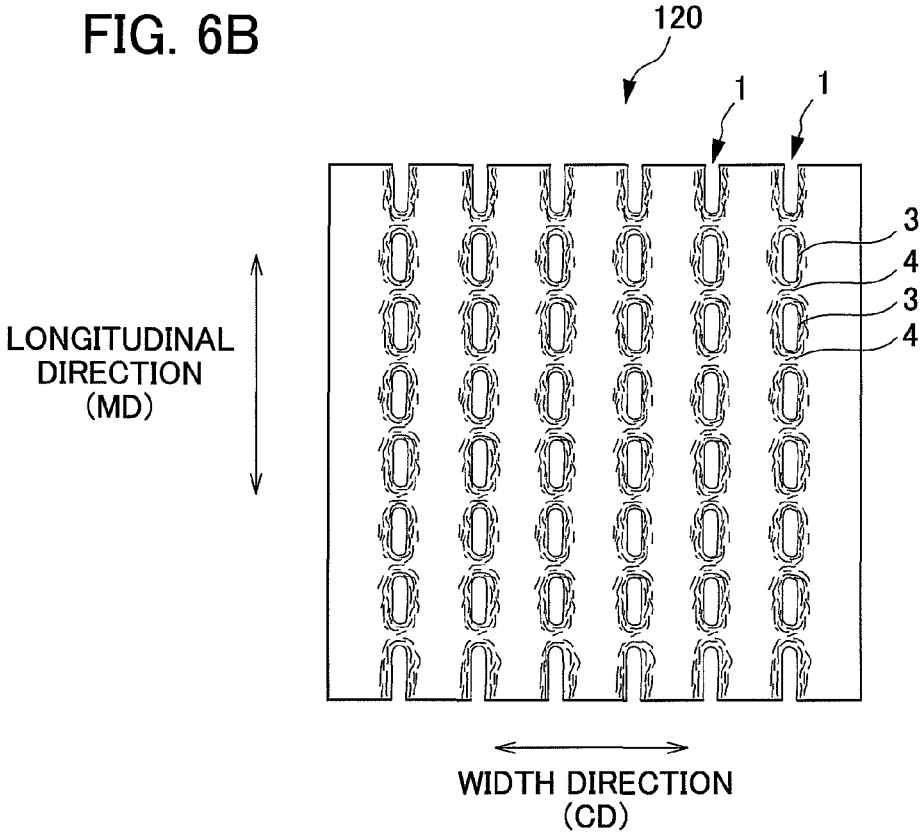
FIG. 6B is a bottom view of a nonwoven fabric of a second embodiment.

A netted supporting member 210, as shown in FIGS. 4A and 4B, for example, may be exemplified as the breathable supporting member which allows fluid mainly containing gas to pass through without any substantial change in flow direction. The netted supporting member 210 is formed with fine netted members configured so that thin wires are woven. The netted supporting member 210 is a breathable supporting member on which nets or first permeable portions, described later, are arranged across the entirety.

In addition, the breathable supporting member 200 may be configured with permeable portions which allow fluid mainly containing gas blown from the topside of the fiber web 100 to pass through to the underside or opposite side of the breathable supporting member 200 on which the fiber web 100 is arranged, and impermeable portions which do not allow fluid mainly containing gas blown from the topside of the fiber web 100 to pass through to the underside of the breathable supporting member 200, or the fibers 101 (FIG. 1) constituting the fiber web 100 to be displaced to the opposite side of the breathable supporting member 200.

A supporting member configured by placing impermeable members on a predetermined netted member through predetermined patterning, or a supporting member configured by forming predetermined holes in an impermeable flat member, may be exemplified as the breathable supporting member 200.

Figure 8A:
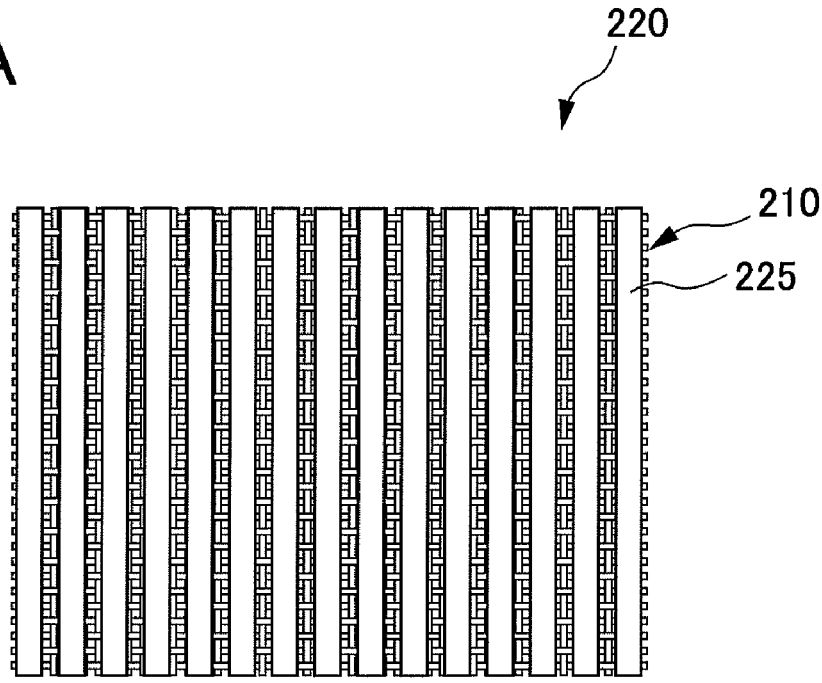
FIG. 8A is a plan view of a supporting member configured with elongated members arranged on a netted supporting member at equal intervals in parallel.
Figure 8B:
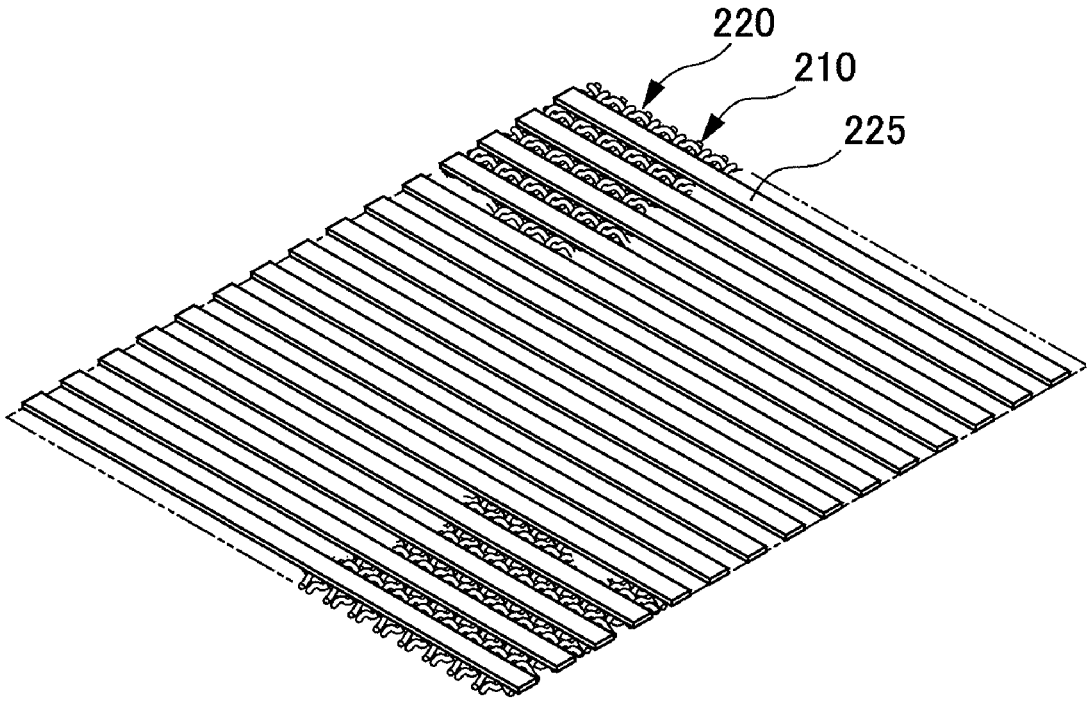
FIG. 8B is a perspective view of a supporting member configured with elongated members arranged on a netted supporting member at equal intervals in parallel.
Figure 9:
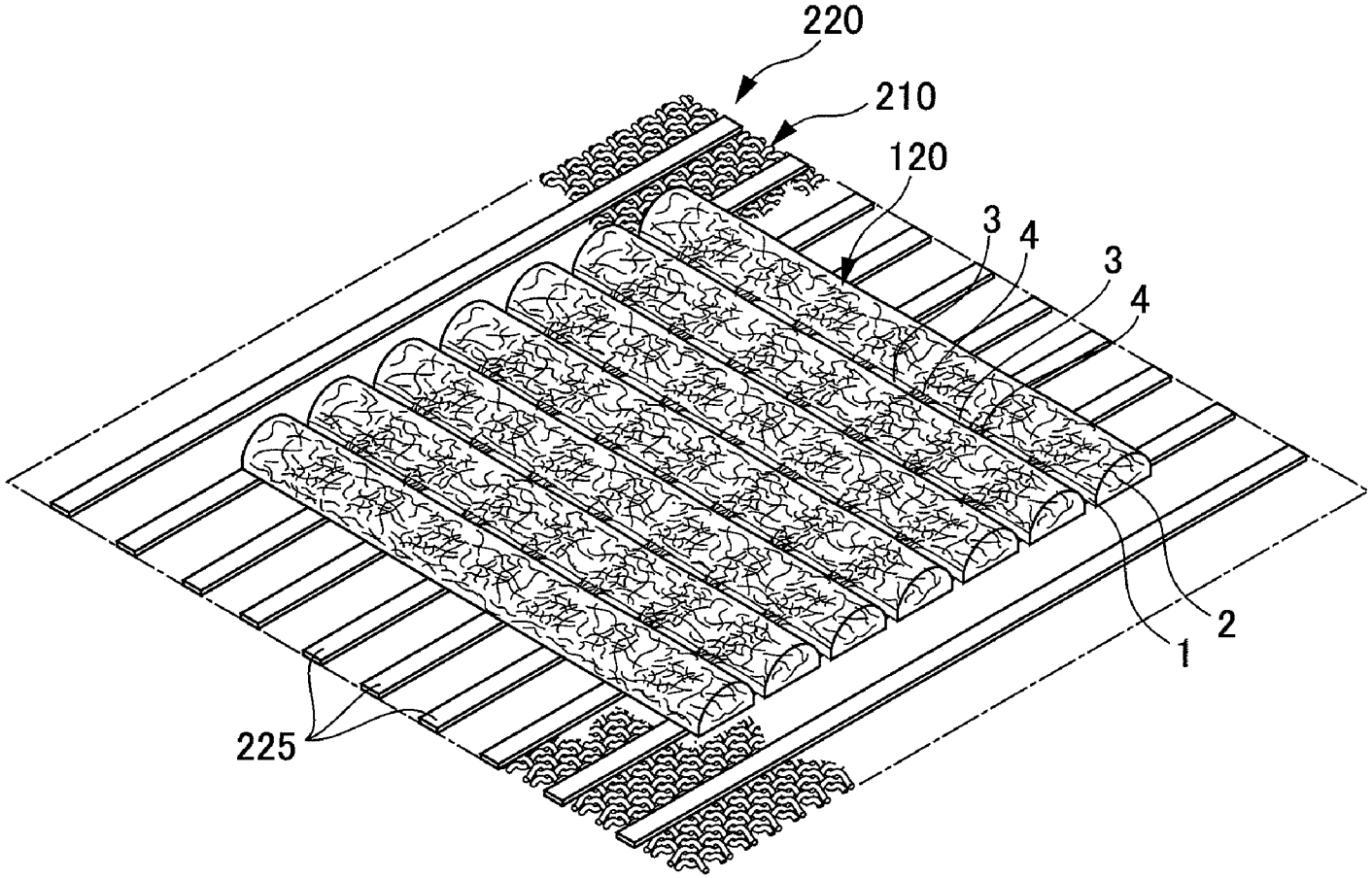
FIG. 9 is a diagram illustrating the nonwoven fabric of the second embodiment in FIGS. 6A and 6B being manufactured by blowing a gas onto the topside of the fiber web of FIG. 1, while the underside is supported by the supporting member of FIGS. 8A and 8B.

A supporting member 220, which is the netted supporting member 210 shown in FIGS. 8A and 8B on the entire surface of which elongated members 225 or impermeable members are arranged in parallel at equal intervals, may be exemplified as the supporting member, which is the predetermined netted member in which impermeable members are arranged through predetermined patterning. In this case, supporting member on which elongated members 225 or impermeable members having the shape and arrangement are changed as needed may be exemplified as another embodiment. The impermeable portions may be formed by filling in mesh holes or permeable portions (with solder or resin), or arranging the elongated members 225 shown in FIGS. 8A and 8B on the entire surface of the netted supporting member 210.

Figure 11A:
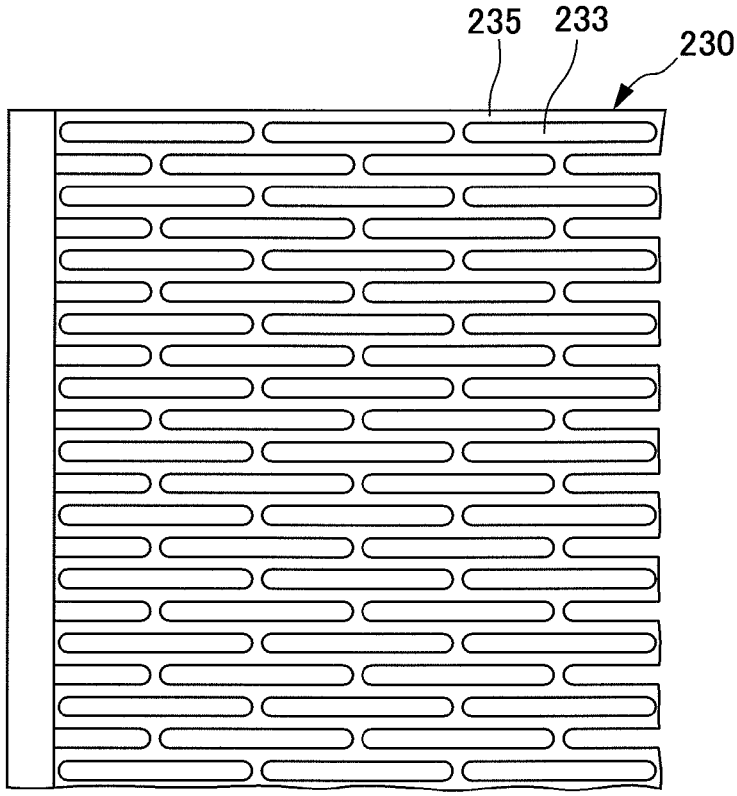
FIG. 11A is a plan view of a flat supporting member on which elliptical openings are formed.
Figure 11B:
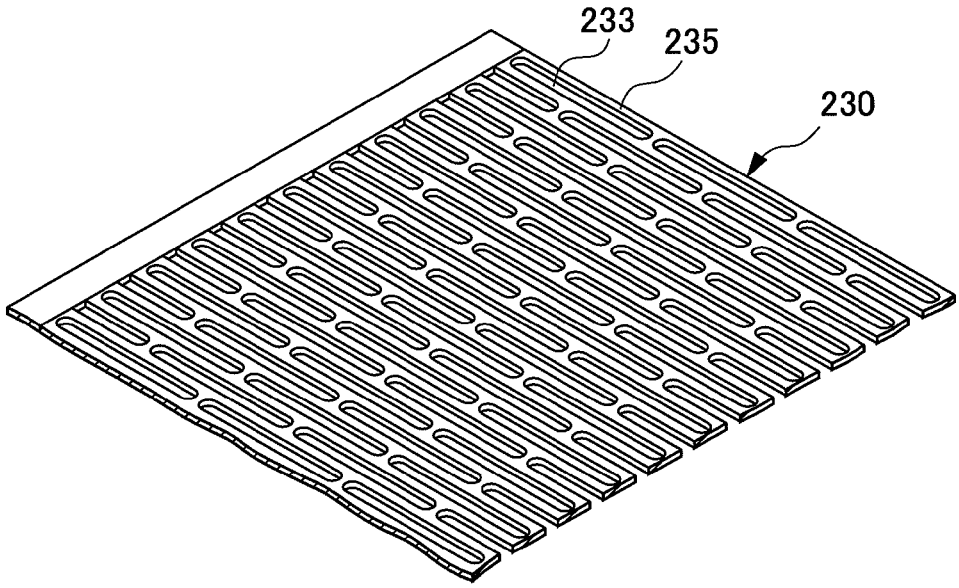
FIG. 11B is a perspective view of a flat supporting member on which elliptical openings are formed.

A flat supporting member 230 in which elongated holes 233 or permeable portions shown in FIG. 11A and FIG. 11B are formed may be exemplified as a member configured by forming predetermined openings in an impermeable flat member. In this case, a flat supporting member in which holes 233, having a shape, size, and arrangement changeable as needed, may be exemplified as another embodiment. In other words, a flat supporting member on which plate portions 235 or impermeable portions having a shape and the like changeable as needed may be exemplified as another embodiment.

In this case, the permeable portions in the breathable supporting member 200 include first permeable portions which do not allow the fibers 101 constituting the fiber web 100 to substantially displace to the opposite side (underside) of the breathable supporting member 200 on which the fiber web 100 is placed, and second permeable portions which allow the fibers constituting the fiber web 100 to displace to the opposite side of the breathable supporting member.

The netted regions of the netted supporting member 210 may be exemplified as the first permeable portions. In addition, the holes 233 of the flat supporting member 230 may be exemplified as the second permeable portions.

The netted supporting member 210 may be exemplified as the breathable supporting member 200 having the first permeable portions. The supporting member 220 may be exemplified as the breathable supporting member 200 having the impermeable portions and the first permeable portions. The flat supporting member 230 may be exemplified as the supporting member having the impermeable portions and the second permeable portions.

In addition, the breathable supporting member 200 constituted of the first permeable portions and the second permeable portions, and the breathable supporting member 200 constituted with the impermeable supporting members, the first permeable portions, and the second permeable portions, may also be exemplified. A breathable base, which is the netted supporting member 210 shown in FIGS. 4A and 4B, in which openings are formed, may be exemplified as the breathable supporting member 200 constituted of the first permeable portions and the second permeable portions. In addition, a breathable supporting member, which is the supporting member 220 shown in FIGS. 8A and 8B, in which openings are formed on the netted regions, may be exemplified as the breathable supporting member 200 constituted of the impermeable supporting members, the first permeable portions, and the second permeable portions.

A supporting member with a planar or curved shaped side by which the fiber web 100 is supported and a substantially flat surface in the planar or curved shaped may also be exemplified as a breathable supporting member 200. A flat or cylindrical shape, for example, may be exemplified as the planar or curved shape. In addition, substantially flat indicates that the side itself of the supporting member on which the fiber web 100 is placed is not formed in an irregular shape, or the like. More specifically, a supporting member where a net of the netted supporting member 210 is not formed in an irregular shape or the like may be exemplified.

A flat supporting member or a cylindrical supporting member may be exemplified as the breathable supporting member 200. More specifically, the aforementioned netted supporting member 210, the supporting member 220, the flat supporting member 230, and a breathable supporting drum 250 shown in FIGS. 18 and 19 may be exemplified.

In this case, the breathable supporting member 200 may be arranged detachably in the nonwoven fabric manufacturing apparatus 90. This allows for arrangement of the breathable supporting member 200 as needed according to the desired fiber orientation, fiber density, or basis weight, or desired shapes of groove portions, openings, or protrusions of the nonwoven fabric. In other words, the breathable supporting member 200 in the nonwoven fabric manufacturing apparatus 90 may be replaced with another breathable supporting member selected from a plurality of different breathable supporting members. In addition, it may be said that the present invention includes a nonwoven fabric manufacturing system which is constituted of the nonwoven fabric manufacturing apparatus 90 and a plurality of different breathable supporting members 200.

The netted portions of the netted supporting member 210, shown in FIGS. 4A and 4B, or the supporting member 220, shown in FIGS. 8A and 8B, are described below. A breathable net, which is woven into plain-woven fabric, twilled fabric, satin, double cloth, spiral cloth, or the like, using thread made of resin such as polyester, polyphenylene sulfide, nylon, or conductive monofilament, or thread made of a metal such as stainless steel, copper, or aluminum, may be exemplified as these breathable netted portions.

In this case, the air permeability of this breathable net may be partially changed by partially changing the weaving method, thread size, or thread shape. More specifically, a breathable mesh woven into a spiral cloth using polyester thread, or a breathable mesh woven into a spiral cloth using flat thread and round thread made of stainless steel may be exemplified.

In addition, a silicon resin or the like may be patterned and coated onto a breathable net or a nonconductive material may be partially bonded together instead of the elongated members 225 being arranged across the entire surface of the supporting member 220, as shown in FIGS. 8A and 8B. For example, the silicon resin may be coated on a 20-mesh breathable net which is plain woven using polyester so as to extend in a width direction and alternate in a line flow direction or machine direction (MD). In this case, the silicon resin, or nonconductive material, serves as bonded impermeable portions, and other portions serve as the first permeable portions. It is preferable that the surface of the impermeable portions be smooth to increase a sliding property of the surface.

A sleeve made of a metal such as stainless steel, copper, aluminum, or the like may be exemplified as the flat supporting member 230 shown in FIGS. 11A and 11B. The metallic plate, which is partially removed into a predetermined pattern, may be exemplified as the sleeve. The portions where the metal is removed serve as the second permeable portions, and other portions serve as the impermeable portions. In addition, it is preferable that the surface of the impermeable portions be smooth to increase the sliding property of the surface as described above.

A 0.3 mm thick sleeve made of stainless steel which is a horizontal rectangle with rounded corners 3 mm long and 40 mm wide in which holes, which are hollowed out metal, are arranged in a grid at 2 mm intervals in a line flow direction (machine direct ion (MD)) and at 3 mm intervals in a width direction, may be exemplified as the sleeve.

In addition, a sleeve in which holes are arranged zigzag may be exemplified. For example, a 0.3 mm thick sleeve made of stainless steel in which circular holes or hollowed metal of 4 mm diameter are arranged zigzag at 12 mm intervals in the line flow direction (machine direction (MD)) or manufacturing line flow direction of the manufacturing apparatus 90, and at 6 mm intervals in the width direction may be exemplified as the sleeve. As described above, a pattern (openings to be formed) hollowed out from the sleeve and the arrangement of hollowed out and formed holes may be set as needed.

Moreover, the breathable supporting member 200 including undulations in a thickness direction may be exemplified. For example, a breathable base whose regions onto which a jet of fluid mainly containing gas is not directly jetted include alternating undulations (e.g., wavy) in a line flow direction (machine direction (MD)) may be exemplified. Use of such a shaped breathable supporting member 200 adjusts fiber orientation, fiber density, or basis weight, forms groove portions, openings, or protrusions, and allows provision of a nonwoven fabric which is entirely formed into a shape corresponding to the undulations (e.g., wavy) of the breathable supporting member 200.

In this case, if the structures of the breathable supporting member 200 differ, fiber orientation, fiber density, or basis weight, or shapes or sizes of groove portions, openings, or protrusions to be formed of the fibers 101 constituting the fiber web 100 completely differ, even if the gas is blown onto the fiber web 100 from the gas ejecting unit 910 under the same conditions. In other words, it is possible to provide a nonwoven fabric with desirably adjusted fiber orientation, fiber density, or basis weight, or desirably formed groove portions, openings, or protrusions by selecting the breathable supporting member 200 as needed.

In addition, the nonwoven fabric manufacturing apparatus 90 of this embodiment is characterized in being capable of manufacturing a nonwoven fabric with adjusted fiber orientation, fiber density, or basis weight, or predetermined groove portions, openings, or protrusions formed by continuously blowing a fluid mainly containing gas onto the fiber web 100 from a gas ejecting means.

5-1-2-2. Conveying Mechanism

The conveying mechanism conveys the fiber web 100 in a predetermined direction while being supported by the above-mentioned breathable supporting member 200 from a first side. More specifically, the conveying mechanism conveys the fiber web 100 onto which a jet of fluid mainly containing gas is being blown in a predetermined direction F. The conveyer 930 shown in FIG. 14, for example, may be exemplified as the conveying mechanism. The conveyer 930 is constituted of a breathable belt 939, which is formed in a horizontal ring shape and on which the breathable supporting member 200 is placed, and rotors 931 and 933, which are placed at either end inside of the breathable belt 939 in the longitudinal direction and rotate the breathable belt 939 in a predetermined direction. In this case, if the breathable supporting member 200 is the netted supporting member 210 of FIGS. 4 and 4B, or the supporting member 220 in FIGS. 8A and 8B, the above-mentioned breathable belt 939 may not be provided. If the breathable supporting member 200 is a base in which large openings are formed as the flat supporting member 230 of FIGS. 11A and 11B, it is preferable that the breathable belt 939 be provided in order to prevent the fibers constituting the fiber web 100 from falling from the openings and entering a machine to be used for processes. A netted belt, for example, is preferable as the breathable belt 939.

As mentioned above, the conveyer 930 conveys the breathable supporting member 200 in the predetermined direction F, while supporting the fiber web 100 from the underside. More specifically, as illustrated in FIG. 14, the fiber web 100 is conveyed so as to pass under the gas ejecting unit 910. Moreover, the fiber web 100 is conveyed so as to pass through the inside of a heater 950, which is a heating device with both sides thereof opened.

Figure 18:
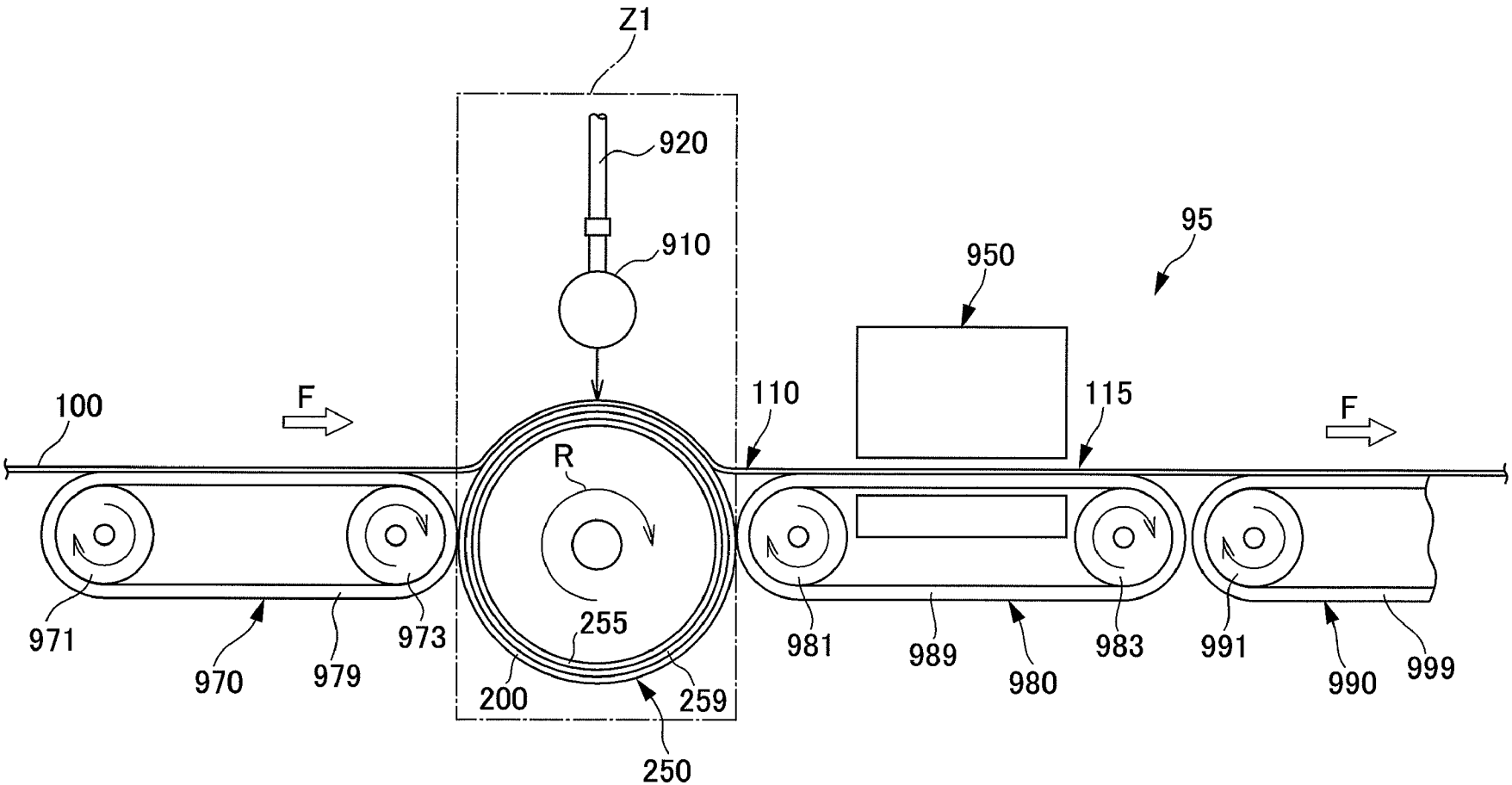
FIG. 18 is a lateral view illustrating a nonwoven fabric manufacturing apparatus of the second embodiment.

In addition, as illustrated in FIG. 18, a combination of multiple conveyers may be exemplified as the conveying mechanism. Such a configuration allows for the adjustment of conveying rate of the fiber web 100 to move towards and away from the gas ejecting unit 910 as needed, thereby allowing for adjustment of the fiber orientation, fiber density, or basis weight, or shapes and the like of the groove portions, openings, or protrusions of a nonwoven fabric 115. Details are described below.

5-1-2-3. Blowing Device

The blowing device is configured with an gas supplying unit, not shown in the drawing, and the gas ejecting unit 910.

Figure 17:
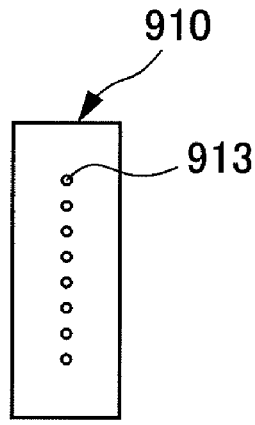
FIG. 17 is a bottom view of the gas ejecting unit of FIG. 16.

The gas supplying unit, not shown in the drawing, is connected to the gas ejecting unit 910 via an air pipe 920. The air pipe 920 is connected to the topside of the gas ejecting unit 910 so as to allow for ventilation. As illustrated in FIG. 17, nozzles 913 are formed at predetermined intervals in the gas ejecting unit 910.

Gas, which is supplied from the gas supplying unit, not shown in the drawing, to the gas ejecting unit 910 via the air pipe 920, is ejected from the nozzles 913 formed in the gas ejecting unit 910. The gas ejected from the nozzles 913 is continuously blown onto the topside of the fiber web 100, which is supported by the breathable supporting member 200 from the underside. More specifically, the gas ejected from the plurality of nozzles 913 is continuously blown onto the topside of the fiber web 100, which is being conveyed in the predetermined direction F by the conveyer 930.

An air intake unit 915, which is placed below the gas ejecting unit 910 or on the underside of the breathable supporting member 200, takes in gas and the like ejected from the gas ejecting unit 910 and passed through the breathable supporting member 200. In this case, it is possible to position the fiber web 100 so as to be attached to the breathable supporting member 200 through an air intake by the air intake unit 915. Moreover, it is possible to convey the fiber web 100 to the inside of the heater 950 while maintaining the shape of the groove portions (concavity and convexity) and the like formed by airflow through the air intake. In short, it is preferable that conveying is carried out while taking in air from the underside by the air intake unit 951, which is subjected to heat treatment by the heater X 950 simultaneously with the forming by airflow.

Figure 16:
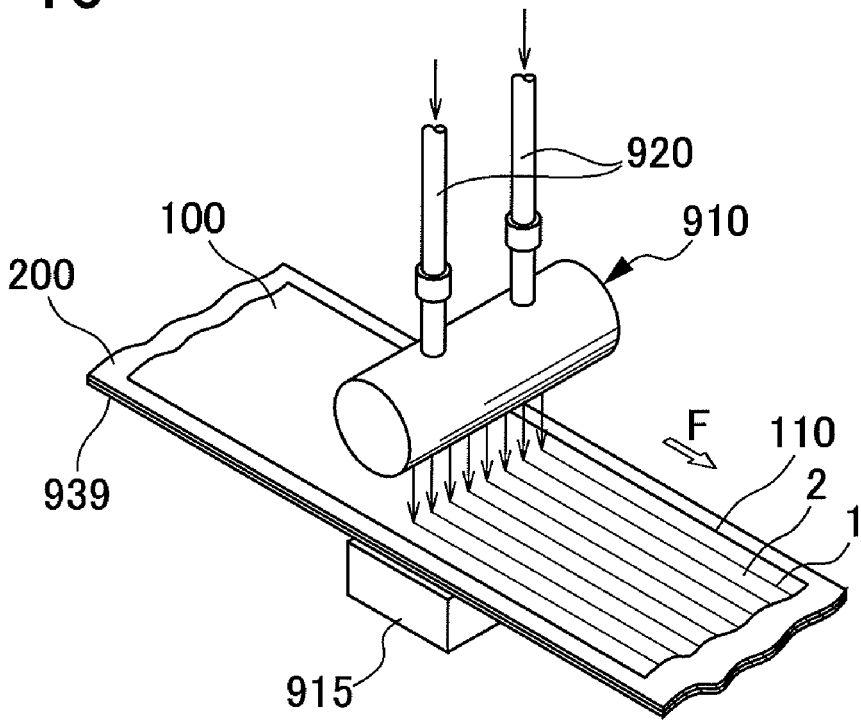
FIG. 16 is a magnified perspective view of the region Z of FIG. 14.

A nonwoven fabric 110, which is the fiber web 100 on the topside of which the groove portions 1, are formed at predetermined intervals by fluid mainly containing gas ejected from the nozzles 913 (see FIG. 17), which are formed at predetermined intervals in a width direction of the fiber web 100, is manufactured as illustrated in FIG. 15 or 16.

An gas ejecting unit in which the nozzles 913 with a diameter of 0.1 to 30 mm, preferably 0.3 to 10 mm, and with pitches therebetween of 0.5 to 20 mm, preferably 3 to 10 mm, are formed, may be exemplified as the gas ejecting unit 910.

A substantially circle, an ellipse, a square, or a rectangle may be exemplified as the shape of the nozzles 913; however, it is not limited thereto. In addition, a cylindrical shape, a trapezoid, or an inverted trapezoid may be exemplified as the cross-sectional shape of the nozzles 913; however, it is not limited thereto. It is preferable that the shape of the nozzles 913 is a substantially circle and the cross-sectional shape thereof is a cylindrical shape in order for the air to be effectively blown onto the fiber web 100.

The nozzles 913 may be designed according to desired fiber orientation, fiber density, or basis weight, or predetermined groove portions, openings, or protrusions of the nonwoven fabric. In addition, the size and shape of openings of the plurality of nozzles 913 may be different from each other. Moreover, the nozzles 913 may be formed so as to be in multiple rows in the gas ejecting unit 910.

The temperature of fluid, which mainly contains gas and is ejected from the respective nozzles 913, may be room temperature, as mentioned above; however, it may be adjusted to be at least a softening point of thermoplastic fibers constituting the fiber web 100, preferably at least the softening point and at most 50 degrees centigrade greater than the melting point thereof, in order to improve the formability of the groove portions (concavity and convexity), the openings, or the protrusions. Since when the fibers are softened, the repulsive force of the fibers themselves decreases, the shape of fibers rearranged by airflow or the like may be easily maintained, and the shape of the groove portions (concavity and convexity) and the like may be further easily maintained since heat-sealing between fibers begins when the temperature is raised further. This makes it easier to convey to the inside of the heater 950, while maintaining the shape of the groove portions (concavity and convexity) and the like.

In order to the fiber aggregate convey to the heater 950 while further maintaining the shape of the groove portions (concavity and convexity) and the like formed by airflow or the like, it is possible to convey to the inside of the heater 950 just after or simultaneous with forming of the groove portions (concavity and convexity) and the like by airflow or the like, or to convey to the heater 950 after cooling by way of cold air or the like just after forming the groove portions (concavity and convexity) and the like by hot air (airflow at a predetermined temperature).

In this case, the flow velocity and flow rate of gas ejected from the gas ejecting unit 910, in addition to the structure of the abovementioned breathable supporting member 200, may be exemplified as elements to adjust fiber orientation, fiber density, or basis weight, or shapes or sizes of groove portions, openings, or protrusions to be formed of the fibers 100 by displacing the fibers 101 in the fiber web 100. It is possible to adjust the flow velocity and flow rate of the gas to be ejected according to the amount of air supplied by the gas supplying unit, not shown in the drawing, and the number and size of the nozzles 913 formed in the gas ejecting unit 910.

In addition, the intervals of concave portions (groove portions), heights of the raised ridge portions, and the like of concavity and convexity to be formed may be adjusted by adjusting the gas ejecting unit 910 so that orientation of the fluid mainly containing gas is changeable. Moreover, it is possible to adjust the shape of groove portions and the like as needed so as to be vermiculated (wavy or zigzag) or another shape by configuring the orientation of the abovementioned fluid so as to be automatically changeable. Furthermore, the shapes and forming patterns of the groove portions and openings may be adjusted as needed by adjusting the amount and duration of ejecting the fluid mainly containing gas. The angle of blowing the fluid mainly containing gas onto the fiber web 100 may be perpendicular, or it may be oriented at a predetermined angle in a line flow direction or a conveying direction F, or it may be oriented at a predetermined angle in a direction opposite to the line flow direction in the conveying direction F of the fiber web 100.

5-1-2-4. Heating Device

Both ends of the heater 950 or the heating device are opened in the predetermined direction F. This conveys the fiber web 100 (nonwoven fabric 110) placed on the breathable supporting member 200 to be conveyed by the conveyer 930 through a heating space formed within the heater 950, holds it for only a predetermined period of time, and then carries it to the outside. If thermoplastic fibers are included in the fibers 101 constituting the fiber web 100 (nonwoven fabric 110), the nonwoven fabric 115 in which the fibers are heat-sealed by heating in the heater 950 and chilled by way of being carried to the outside to heat-seal the fibers 101 together at the intersecting points, may be provided.

A needle-punch method, a spun-lace method, bonding by a solvent bonding method, or thermal bonding by a point bond method or an air-through method may be exemplified as methods of bonding the fibers 101 in the nonwoven fabric 110 having fiber orientation, fiber density, or basis weight adjusted and/or one or more of the predetermined groove portions, openings, and protrusions formed. In addition, the air-through method is preferable for bonding between the fibers 101 while maintaining the adjusted fiber orientation, fiber density, or basis weight, or the shapes of the formed predetermined groove portions, openings, or protrusions. For example, heat treatment by the air-through method using the heater 950 is preferred.

5-1-2-5. Other

The nonwoven fabric 115 heated by the heater 950 and then manufactured is conveyed by a conveyer 940 continuing from the conveyer 930 in the predetermined direction F to a process of cutting the nonwoven fabric 115 in a predetermined shape or a rolling process, for example. The conveyer 940 is constituted with a belt 949, a rotor 941, and the like as with the conveyer 930.

5-2. Nonwoven Fabric Manufacturing Apparatus of Second Embodiment

A nonwoven fabric manufacturing apparatus according to a second embodiment of the present invention is described below while referring to FIGS. 18 and 19. A nonwoven fabric manufacturing apparatus 95 according to the second embodiment is different from the nonwoven fabric manufacturing apparatus 90 according to the first embodiment in forms of the conveying mechanism and a breathable supporting member 200. Differences of the nonwoven fabric manufacturing apparatus 95 are mainly described below.

5-2-1. Overall Structure

The nonwoven fabric manufacturing apparatus 95 of this embodiment is configured with a first conveyer 970 or a first conveying mechanism, which conveys a fiber web 100 so as to move towards an gas ejecting unit 910, and a second conveyer 980 or a second conveying mechanism, which conveys the fiber web 100 so as to move away from the gas ejecting unit 910. A breathable supporting drum 250 is placed between the first conveyer 970 and the second conveyer 980. The gas ejecting unit 910 constituting an exhausting means is placed on the topside of the breathable supporting drum 250. Other components are the same as those of the nonwoven fabric manufacturing apparatus 90 of the first embodiment.

The fiber web 100 conveyed by the first conveyer 970 in the predetermined direction F is conveyed to the topside (cylindrical side) of the breathable supporting drum 250. The fiber web 100 conveyed to the topside (cylindrical side) of the breathable supporting drum 250 is conveyed to the second conveyer 980 side, while being supported by the topside of the breathable supporting drum 250 when the breathable supporting drum 250 rotates in an R direction.

Fluid mainly containing gas ejected from the gas ejecting unit 910 is blown onto the topside of the fiber web 100, which is being conveyed in the predetermined direction F while being supported by the topside of the breathable supporting drum 250. A nonwoven fabric 110 onto which fluid mainly containing gas is blown, having a fiber orientation, fiber density, or basis weight adjusted, and on which predetermined groove portions, openings, or protrusions are formed, is conveyed to the heater 950 or heating device by the second conveyer 980. The nonwoven fabric 110, having a temperature raised to a predetermined temperature (melting temperature of thermoplastic fibers included in the fiber web 100) in the heater 950, becomes a nonwoven fabric 120 having an adjusted fiber orientation, fiber density, or basis weight, and the formed predetermined groove portions, openings, or protrusions thereupon are maintained.

5-2-2. Components 5-2-2-1. Breathable Supporting Member

The breathable supporting member 200 of this embodiment is different from the first embodiment in that it is formed in a cylindrical shape. The breathable supporting member 200 of this embodiment is arranged so as to be stacked on a drum-shaped breathable belt 259 at an outer side of a cylindrical breathable drum 255 and the drum-shaped breathable belt 259 going around the sides of the breathable drum 255, and constitutes the cylindrical breathable drum 250. In this case, if the breathable supporting member 200 is a netted supporting member 210 of FIGS. 4A and 4B, or a supporting member 220 of FIGS. 8A and 8B, the abovementioned drum-shaped breathable belt 259 may not be provided. If the breathable supporting member 200 is a base in which large openings are formed as a flat supporting member 230 in FIGS. 11A and 11B, it is preferable that the drum-shaped breathable belt 259 is provided in order to prevent the fibers constituting the fiber web 100 from falling from the openings and entering a machine to be used for processes. A netted belt, for example, is preferable as the drum-shaped breathable belt 259.

The breathable supporting drum 250 is placed between the abovementioned first conveyer 970 and the second conveyer 980. The breathable supporting drum 250 is disposed so that both ends thereof face towards a lateral side in a conveying direction F of the fiber web 100. In other words, it is disposed so that the sides of the breathable supporting drum 250 are substantially horizontal. For example, it is disposed as if the breathable supporting drum 250 is turned sideways.

The breathable supporting drum 250 is disposed so as to allow for rotation around a cylindrical axis in an R direction. Rotation of the breathable supporting drum 250 in the R direction conveys the fiber web 100 placed on the sides thereof in the predetermined direction F.

A predetermined air intake unit and the like may be placed inside (inside the cylinder) of the breathable supporting drum 250. This allows for suction of the fluid mainly containing gas ejected from the gas ejecting unit 910, with the fiber web 100 being positioned on the topside of the breathable supporting drum 250.

Moreover, adjustment of regions able to be suctioned by a suction unit allows for adjustment of the strength and regions where the fiber web 100 is positioned. This allows for adjustment of the shapes of the groove portions, the openings, or the protrusions.

In addition, the breathable supporting drum 250 is arranged detachably in the nonwoven fabric manufacturing apparatus 95. In other words, it is disposed to be replaceable with another breathable supporting drum selected from a plurality of different breathable supporting drums. This allows for the nonwoven fabric manufacturing apparatus 95 to provide the breathable supporting drum on the outer side of which the breathable supporting member 200 is placed as needed according to the desired fiber orientation, fiber density, or basis weight, or the desired shapes of groove portions, openings, or protrusions of the nonwoven fabric.

The abovementioned netted supporting member 210, the supporting member 220, and the flat supporting member 230 may be exemplified as the breathable supporting member 200 provided in the breathable drum 255. In other words, the breathable supporting drum 250 in which such netted supporting member 210, the supporting member 220, or the flat supporting member 230 is placed so as to be along the outer side of the breathable drum 255 may be exemplified.

Use of the breathable supporting drum 250 may allow for shorter manufacturing lines. In addition, in the case of a manufacturing apparatus (system) using a predetermined breathable supporting drum selected from a plurality of different breathable drums as the breathable supporting drum 250, for example, the breathable drum is smaller than the case of using a belt-type supporting member, thereby allowing for a reduction in storage space for an unused breathable supporting member (drum).

5-2-2-2. Conveying Mechanism

The nonwoven fabric manufacturing apparatus 95 is constituted with the first conveyer 970, which conveys the fiber web 100 so as to move towards the gas ejecting unit 910, and the second conveyer 980, which conveys the fiber web 100 so as to move away from the gas ejecting unit 910. In this embodiment, the first conveyer 970 serves as the first conveying mechanism and the breathable supporting drum 250 serves as the second conveying mechanism. Adjusting a first conveying rate of the fiber web 100 in the first conveyer 970 and a second conveying rate of the fiber web 100 by rotating the breathable supporting drum 250 in the R direction allows for adjustment of tension of the fiber web 100 during conveying. This allows for adjustment of the conveying state of the fibers 101 constituting the fiber web 100, for example.

For example, when the breathable supporting member 200 is the flat supporting member 230, adjusting this tension allows for control of the fibers entering holes 233. In other words, even if the similar flat supporting member 230 is used, a higher tension allows for manufacturing of a nonwoven fabric in which openings, as described later, are formed in plural; conversely, a lower tension allows for manufacturing of a nonwoven fabric in which protrusions, as described later, are formed in plural.

To increase the tension of the fiber web 100, the first conveying rate and the second conveying rate should be adjusted so as to be almost the same; conversely, to decrease the tension, the first conveying rate should be adjusted so as to be faster than the second conveying rate. In this case, the second conveying rate may be adjusted by way of the rotation speed of the breathable supporting drum 250 in the R direction, and the suction strength of the air intake unit disposed inside of the breathable supporting drum 250. Moreover, making the conveying rate of the second conveyer 980 be the same as or faster than the second conveying rate pulls protrusions formed when the fibers 101 enter the holes 233 of the flat supporting member 230 away from the holes 233, and conveys them to the heater 950. In this case, if the first conveying rate is adjusted so as to be faster than the second conveying rate, for example, when the average basis weight of the fiber web 100 before passing through the gas ejecting unit 910 is 100, it is preferable that the aforementioned rate is adjusted so that the average basis weight of the fiber web 100 after passing through the gas ejecting unit 910 falls within a range of 110 to 1000, preferably 120 to 500.

5-2-2-3. Conveyor Controlling Device

The nonwoven fabric manufacturing apparatus 95 includes a control unit or conveyor controlling device, not shown in the drawing. The control unit is constituted with a predetermined CPU and related units, for example. The control unit may control the first conveyer 970, the second conveyer 980, and the breathable supporting drum 250, for example. The control unit may control the first conveying rate of the fiber web 100 on the first conveyer 970, and the second conveying rate of the fiber web 100 on the breathable supporting drum 250. The control unit may adjust the first conveying rate and the second conveying rate according to fiber orientation, fiber density, or basis weight, or predetermined groove portions, openings, or protrusions of the nonwoven fabric 110, respectively.

5-3. Other

The nonwoven fabric manufacturing apparatus 90 according to the first embodiment and the nonwoven fabric manufacturing apparatus 95 according to the second embodiment may include an gas ejecting unit 910 and breathable supporting members 200. For example, it is possible to adjust the fiber orientation, fiber density, or basis weight in multiple steps, and form predetermined groove portions, openings, or protrusions, allowing detailed nonwoven fabric design.

6. Nonwoven Fabric Manufacturing Method 6-1. Adjustment of Fiber Orientation, Fiber Density, or Basis Weight A nonwoven fabric manufacturing method of this embodiment is a method of manufacturing a nonwoven fabric of which one or more of fiber orientation, fiber density, and basis weight is adjusted by blowing a fluid mainly containing gas onto a fiber aggregate, which is formed in a sheet shape and is in a state where at least a part of fibers constituting the fiber aggregate has a degree of freedom.

In addition, the nonwoven fabric manufacturing method of this embodiment includes a supporting step of supporting a fiber aggregate by a breathable supporting member from a first side by arranging the fiber aggregate on a predetermined side of the breathable supporting member or by stacking and arranging predetermined fibers on the predetermined side so as to form the fiber aggregate, a conveying step of conveying the fiber aggregate, which is supported by the breathable supporting member by way of a predetermined conveying mechanism in a predetermined direction, and a blowing step of blowing from a second side a jet of fluid mainly containing gas onto the fiber aggregate, which is conveyed in the predetermined direction in the conveying step by way of a predetermined blowing device.

6-2. Formation of Predetermined Groove Portions, Openings, or Protrusions

The nonwoven fabric manufacturing method of this embodiment is a method of manufacturing a nonwoven fabric in which one or more of predetermined groove portions, openings, and protrusions is formed by blowing a fluid mainly containing gas onto a fiber aggregate, which is formed in a sheet shape and is in a state where at least a part of fibers constituting the fiber aggregate has a degree of freedom.

In addition, the nonwoven fabric manufacturing method of this embodiment includes a supporting step of supporting a fiber aggregate by a breathable supporting member from a first side by arranging the fiber aggregate on a predetermined side of the breathable supporting member, or by stacking and arranging predetermined fibers on the predetermined side so as to form the fiber aggregate, a conveying step of conveying the fiber aggregate, which is supported by the breathable supporting member, by way of a predetermined conveying mechanism in a predetermined direction, and a blowing step of blowing from a second side a jet of fluid mainly containing gas onto the fiber aggregate which is conveyed in the predetermined direction in the conveying step by way of a predetermined blowing device.

6-3. Components 6-3-1. Fibers and Fluid Mainly Containing Gas

The fiber aggregate of this embodiment may include thermoplastic fibers. When the fiber aggregate includes thermoplastic fibers, the temperature of fluid mainly containing gas to be blown by the predetermined blowing device onto the topside or the other side of the fiber aggregate may be set higher than a predetermined temperature so as to allow for softening of the thermoplastic fibers.

For example, it is possible to configure such that the thermoplastic fibers provided in regions or the like onto which a jet of fluid mainly containing gas is blown are softened or melted, and hardened again by setting the temperature of the fluid mainly containing gas to a temperature which allows for softening of the thermoplastic fibers. This preserves fiber orientation, fiber density, or basis weight, or the shapes of groove portions, openings, or protrusions by blowing a fluid mainly containing gas thereupon, for example. In addition, a certain amount of sheet strength, which prevents a fiber aggregate (nonwoven fabric) from coming apart when the fiber aggregate is conveyed by way of a predetermined conveying mechanism, is given, for example. The abovementioned description may serve as a reference for other contents of the fibers and the fluid mainly containing gas.

6-3-2. Supporting Step

A supporting step of this embodiment is a step of making a breathable supporting member support a fiber aggregate from one side by placing the fiber aggregate on a predetermined side of the breathable supporting member, or stacking and placing predetermined fibers on the predetermined side so as to form the fiber aggregate.

Figure 19:
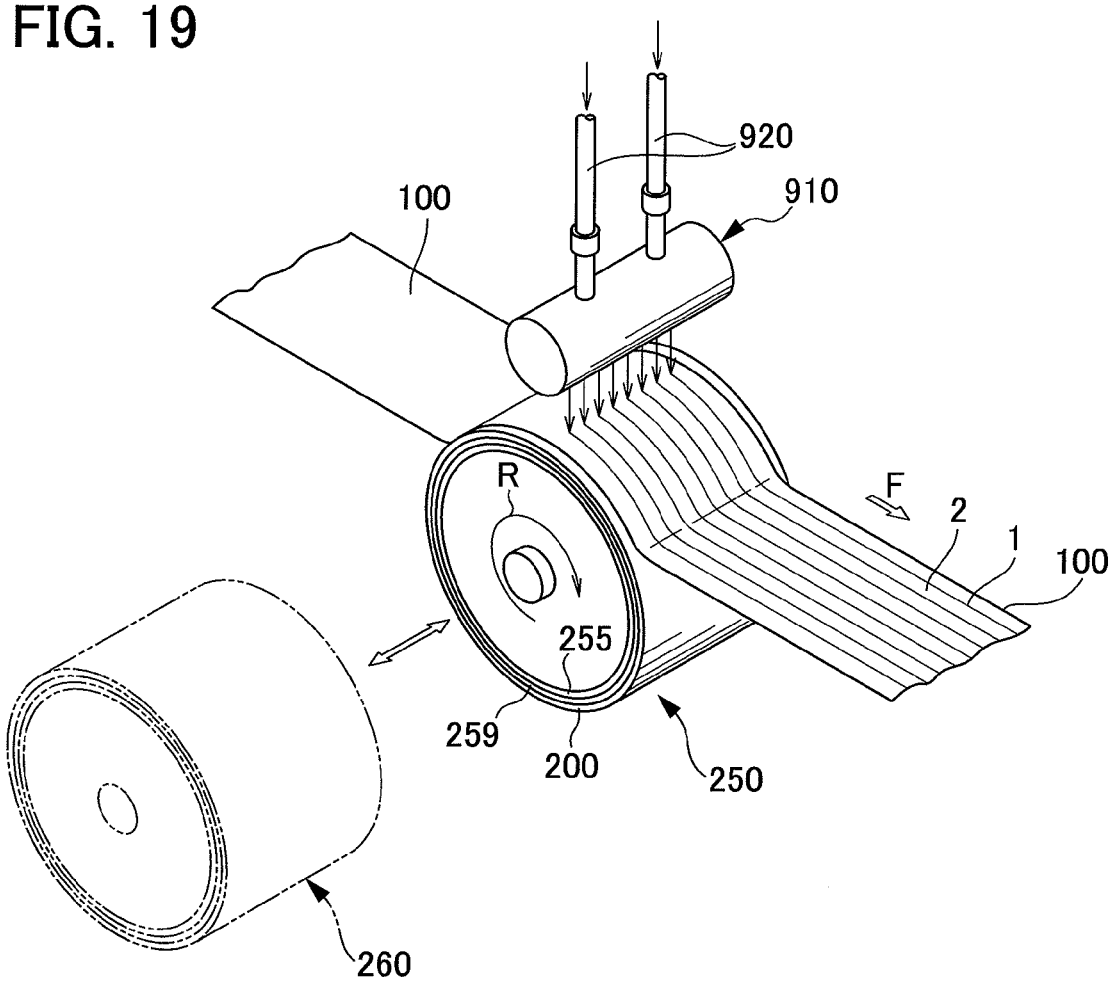
FIG. 19 is a plan view illustrating the nonwoven fabric manufacturing apparatus of FIG. 18.

For example, as illustrated in FIG. 16 or 19, the fiber web 100 may be disposed on the topside of the breathable supporting member, or predetermined fibers may be stacked on the topside of the predetermined breathable supporting member from a fiber ejecting unit, not shown in the drawing, to form a fiber web.

The description of the breathable supporting member 200 given above may serve as a reference for the contents of the breathable supporting member. In addition, for example, the netted supporting member 210, the supporting member 220, the flat supporting member 230, and the breathable supporting drum 250, which is constituted with these and formed in a cylindrical shape, may be exemplified.

The breathable supporting member may be replaced as needed with another breathable supporting member selected from a plurality of different breathable supporting members.

6-3-3. Conveying Step

The conveying step conveys the fiber aggregate, which is supported by the breathable supporting member, by way of a predetermined conveying mechanism in a predetermined direction. The description of the conveyers and the like given above may serve as a reference for contents of the predetermined conveying mechanism.

The conveying step may include a first conveying step of conveying a fiber aggregate to move towards a blowing device, and a second conveying step of conveying the fiber aggregate, which is conveyed in the first step, to move away from the blowing device. The description of the first conveying mechanism and the second conveying mechanism given above may serve as a reference for contents of the first conveying mechanism in the first conveying step, and the second conveying mechanism in the second conveying step.

In this case, the first conveying rate or the conveying rate of the fiber aggregate in the first conveying step may be set faster than the second conveying rate or the conveying rate of the fiber aggregate in the second conveying step. For example, the first conveying rate and the second conveying rate may be adjusted by controlling the first conveying mechanism and the second controlling device, respectively, by way of the abovementioned conveyor controlling device.

6-3-4. Blowing Step

In the blowing step, a jet of fluid mainly containing gas is blown from a second side onto the fiber aggregate, which is conveyed in a predetermined direction in the conveying step, by way of the predetermined blowing device. The description of the abovementioned blowing device may serve as a reference for contents of the blowing device.

In the blowing step, fluid mainly containing gas blown by way of a predetermined blowing device, and/or fluid mainly containing gas which is the blown fluid mainly containing gas that passes through the fiber aggregate and has changed flow direction by way of permeable portions displaces the fibers constituting the fiber aggregate. This adjusts fiber orientation, fiber density, or basis weight constituting the fiber aggregate, and forms predetermined groove portions, openings, or protrusions.

For example, in the blowing step, it is possible to form predetermined groove portions by blowing a fluid mainly containing gas onto regions supported by the permeable portions of the breathable supporting member of the fiber aggregate.

For example, in the blowing step, it is possible to form predetermined openings by blowing a fluid mainly containing gas onto regions supported by impermeable portions of the breathable supporting member of the fiber aggregate.

For example, in the blowing step, it is possible to displace fibers constituting the fiber aggregate so as to enter second permeable portions and form predetermined protrusions by blowing a fluid mainly containing gas onto regions supported by the second permeable portions of the breathable supporting member of the fiber aggregate.

In the blowing step, a case where fluid mainly containing gas is continuously blown onto the second side of the fiber aggregate may be exemplified as a preferred aspect. In this case, selection and use of a breathable supporting member with a predetermined structure, for example, allows for adjustment of fiber orientation, fiber density, or basis weight, or shapes of predetermined groove portions, openings, or protrusions by merely continuously blowing a fluid mainly containing gas thereupon.

6-4. Other

The aforementioned nonwoven fabric manufacturing apparatus 90 and the nonwoven fabric manufacturing apparatus 95 may be exemplified as a device for implementing the nonwoven fabric manufacturing method of this embodiment described above.

7. Nonwoven Fabric 7-1. Adjustment of Fiber Orientation, Fiber Density, or Basis Weight A nonwoven fabric of this embodiment is a nonwoven fabric of which one or more of fiber orientation, fiber density, or basis weight is adjusted by blowing a fluid mainly containing gas onto a fiber aggregate which is formed in a sheet shape and supported from a first side by way of a predetermined breathable supporting member, and which is in a state where at least a part of fibers constituting the fiber aggregate has a degree of freedom.

7-2. Formation of Predetermined Groove Portions, Openings, or Protrusions

In addition, the nonwoven fabric of this embodiment is a nonwoven fabric in which one or more of predetermined groove portions, openings, or protrusions is formed by blowing a fluid mainly containing gas onto a fiber aggregate which is formed in a sheet shape and supported from a first side by way of a predetermined breathable supporting member, and is in a state where at least a part of fibers constituting the fiber aggregate has a degree of freedom.

7-3. Nonwoven Fabric of First Embodiment

The nonwoven fabric according to the first embodiment of the present invention is described below while referring to FIGS. 2 to 5.

7-3-1. Overview

As illustrated in FIG. 2A, 2B, 3, or 5, the nonwoven fabric 110 according to this embodiment is a nonwoven fabric having a plurality of groove portions 1 formed on a first side thereof in parallel at substantially equal intervals. In addition, a plurality of raised ridge portions 2 is formed between the plurality of respective groove portions 1 formed at substantially equal intervals. The raised ridge portions 2 are formed in parallel at substantially equal intervals as with the groove portions 1. In this embodiment, the groove portions 1 are formed in parallel at substantially equal intervals; however, they are not limited thereto. For example, they may be formed at different intervals, or may be formed not in parallel, but so that the intervals between the groove portions 1 vary. Moreover, the raised ridge portions 2 may be formed so that the heights (thicknesses) thereof are not equal, but differ from each other.

The groove portions 1 are formed by displacing the fibers 101 constituting the fiber web 100 by blowing gas thereupon from the topside while supporting the fiber web 100 by the netted supporting member 210 or a breathable supporting member shown in FIGS. 4A and 4B, for example. In addition, this allows for adjustment of fiber orientation, fiber density, or basis weight of the fibers 101 constituting the fiber web 100.

The fibers 101 constituting the fiber web 100 are displaced by fluid mainly containing gas blown thereupon from the topside of the fiber web 100.

The raised ridge portions 2 are regions in the fiber web 100 onto which fluid mainly containing gas is not blown, and are relatively protruding regions due to formation of the groove portions 1. The raised ridge portions 2 are characterized in that orientations, densities, or weights of fibers 101 differ at the sides and central portion of the raised ridge portions 2.

7-3-2. Groove Portions, Openings, or Protrusions

Figure 2A:
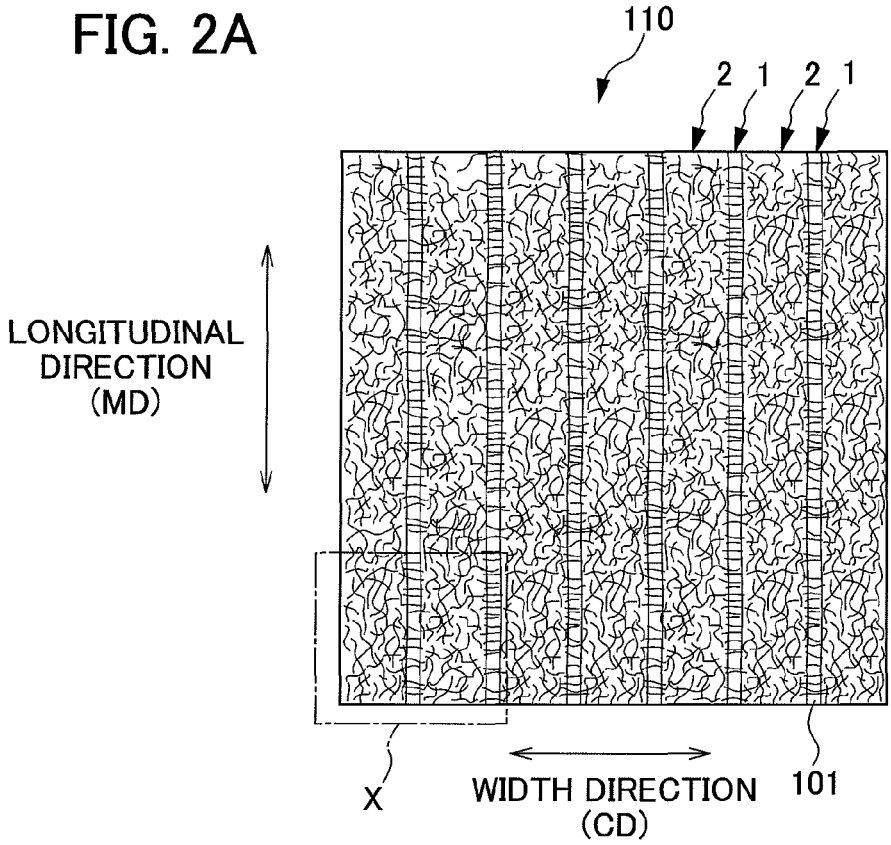
FIG. 2A is a plan view of a nonwoven fabric of a first embodiment.
Figure 2B:
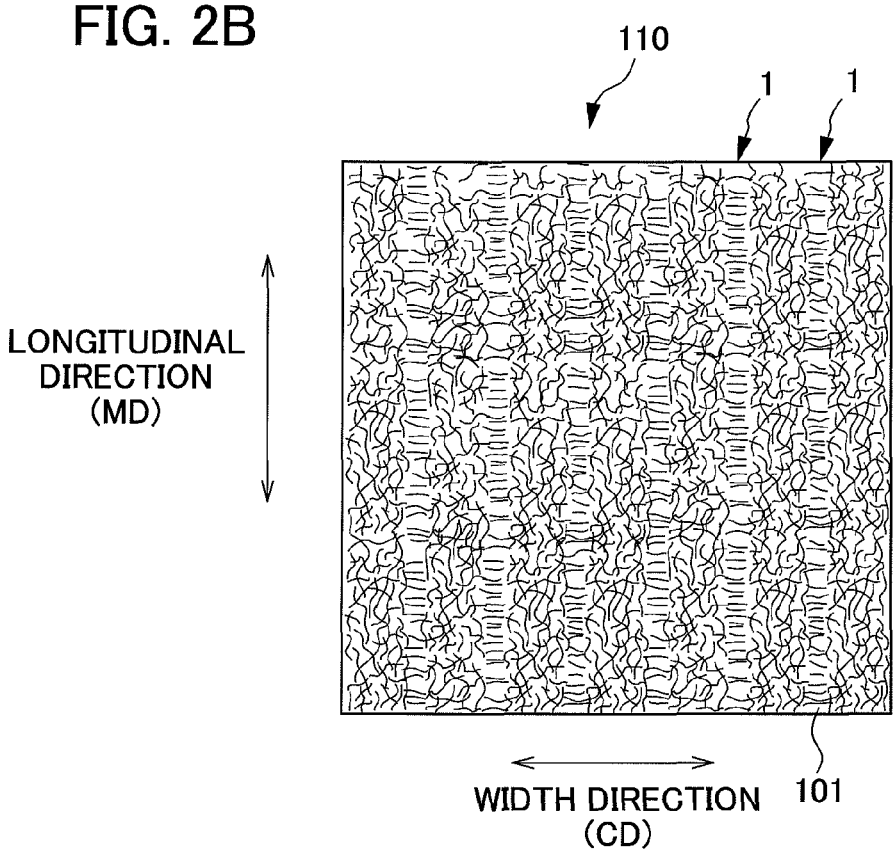
FIG. 2B is a bottom view of a nonwoven fabric of a first embodiment.
Figure 3:
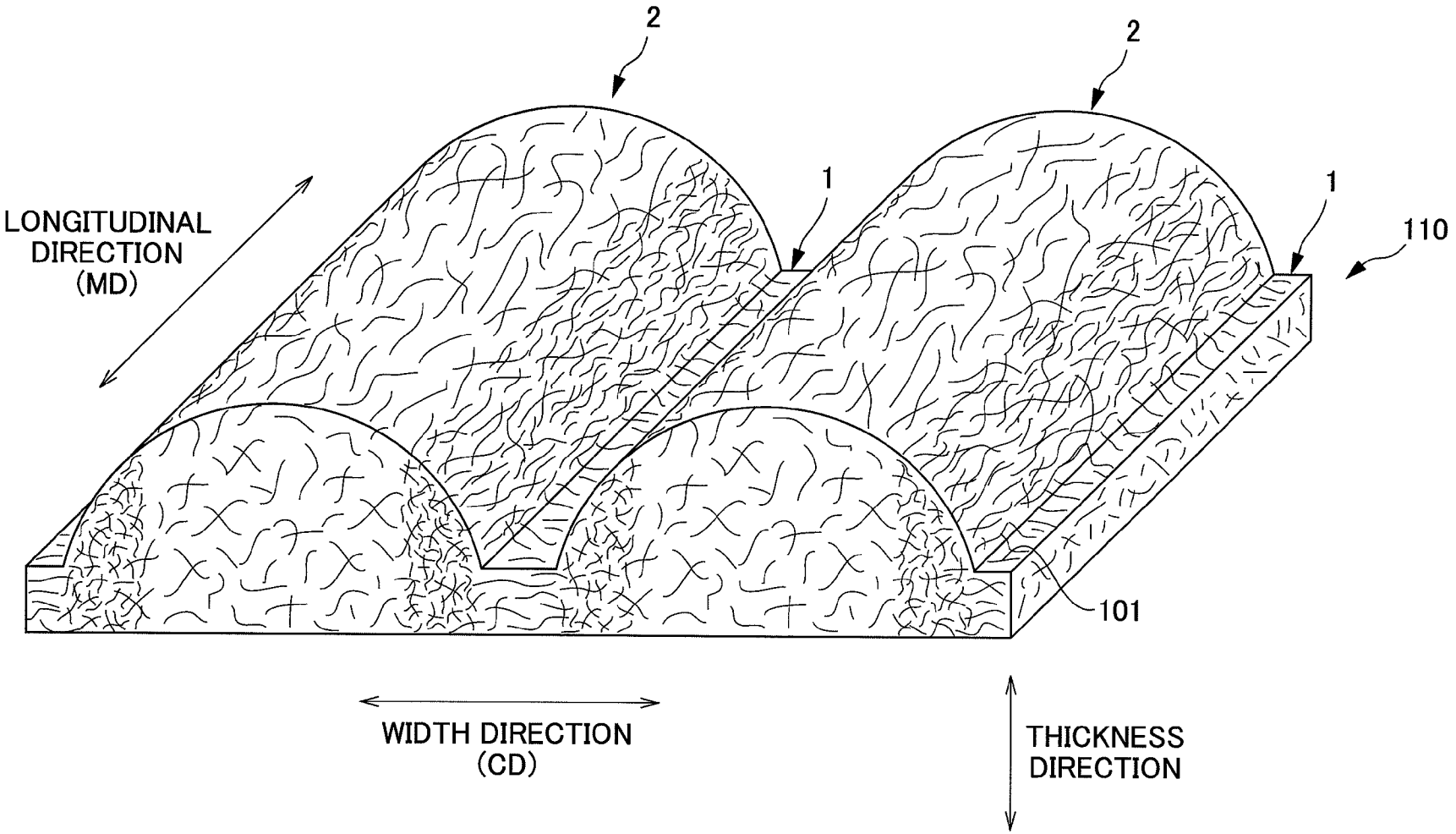
FIG. 3 is a magnified perspective view of a region X in FIG. 2A.

As illustrated in FIGS. 2A, 2B, and 3, the nonwoven fabric 110 according to this embodiment is a nonwoven fabric having a plurality of groove portions 1 formed on a first side thereof in parallel at substantially equal intervals, as described above. In addition, a plurality of raised ridge portions 2 is formed between the plurality of respective groove portions 1 formed at substantially equal intervals. The raised ridge portions 2 are formed in parallel at substantially equal intervals as with the groove portions 1.

In this embodiment, the groove portions 1 are formed in parallel at substantially equal intervals; however, they are not limited thereto. For example, they may be formed at different intervals, or may be formed not in parallel, but so that the intervals between the groove portions 1 vary.

In addition, the heights (thickness direction) of the raised ridge portions 2 of the nonwoven fabric 110 according to this embodiment are substantially equal; however, the heights of the raised ridge portions 2 adjacent to each other may be formed so as to be different from each other. For example, the heights of the raised ridge portions 2 may be adjusted by adjusting the intervals of the nozzles 913 from which fluid mainly consisting of gas is ejected. More specifically, the heights of the raised ridge portions 2 may be lowered by narrowing the intervals of the nozzles 913. On the contrary, the heights of the raised ridge portions 2 may be heightened by widening the intervals of the nozzles 913. Moreover, the raised ridge portions 2 differing in height may be formed alternately by forming the intervals of the nozzles 913 so as to alternate narrow intervals and wide intervals. In this case, as described above, there is an advantage in that a partial change in the heights of the raised ridge portions 2 allows for a reduction in contact area with the skin, thus allowing for a reduction in the burden to the skin.

7-3-3. Fiber Orientation, Fiber Density, or Basis Weight 7-3-3-1. Fiber Orientation As illustrated in FIGS. 2A, 2B, and 3, the fibers 101 in regions constituting the bottom of the groove portions 1 are oriented in a direction intersecting a longitudinal direction (machine direction (MD)) or a direction along which the groove portions 1 extend, and more specifically, along a width direction (cross direction (CD)) intersecting the longitudinal direction.

The fibers 101 disposed on the sides at both ends viewed from a width direction (cross direction (CD)) of the raised ridge portions 2 are oriented in a longitudinal direction (machine direction (MD)) or a direction in which the raised ridge portions 2 and the groove portions 1 extend. For example, the orientation of the fibers 101 is adjusted so that ratio of the fibers 101 oriented in the longitudinal direction (machine direction (MD)) of the fibers 101 disposed at the central portion (a region between both sides) viewed from the width direction (cross direction (CD)) of the raised ridge portions 2 is higher than the ratio of the fibers 101 oriented in the longitudinal direction (machine direction (MD)) of the fibers 101 disposed at the sides.

7-3-3-2. Fiber Density

As illustrated in FIG. 3, the fiber density in the groove portions 1 is adjusted so as to be lower than that in the raised ridge portions 2. In addition, the fiber density in the groove portions 1 may be adjusted as needed according to various conditions such as the amount of fluid mainly containing gas (e.g., hot air) and tension.

As mentioned above, the fiber density in the raised ridge portions 2 is adjusted so as to be higher than that in the groove portions 1. In addition, the fiber density in the raised ridge portions 2 may be adjusted as needed according to various conditions such as the amount of fluid mainly containing gas (e.g., hot air) and tension.

Moreover, the fiber density at side portions of the raised ridge portions 2 may be adjusted as needed according to various conditions such as the amount of fluid mainly containing gas (e.g., hot air) and tension.

7-3-3-3. Basis Weight

As illustrated in FIG. 3, the basis weight of the fibers 101 in a region constituting the bottom of the groove portions 1 is adjusted so as to be lower than that in the raised ridge portions 2. In addition, the basis weight in the region constituting the bottom of the groove portions 1 is adjusted so as to be lower than the average basis weight in the entire nonwoven fabric, including the groove portions 1 and the raised ridge portions 2.

As mentioned above, the basis weight in the raised ridge portions 2 is adjusted so as to be higher than that at the bottom of the groove portions 1. In addition, the basis weight in the raised ridge portions 2 is adjusted so as to be lower than the average basis weight in the entire nonwoven fabric, including the groove portions l and the raised ridge portions 2.

7-3-4. Other

When the nonwoven fabric of this embodiment is used to absorb or pass through a predetermined fluid, the bottom of the groove portions 1 allows the fluid to pass through, making it difficult for the raised ridge portions 2 to hold the fluid since it is a porous structure.

Since the fiber density and the basis weight at the bottom of the groove portions 1 are both low, they are suitable for passing the fluid through. Moreover, since most of the fibers 101 at the bottom of the groove portions 1 are oriented in the width direction, it is possible to prevent the fluid dripped into the groove portions 1 from excessively flowing and widely spreading in the longitudinal direction of the groove portions 1. Since the fibers 101 at the bottom of the groove portions 1 are oriented in the width direction (direction orthogonal to the machine direction (MD)) during manufacturing: cross direction (CD)) regardless of whether the basis weight at the bottom of the groove portions 1 is low, the strength (CD strength) in the width direction (CD) increases.

As described above, since adjusting the basis weight in the raised ridge portions 2 so that it is high increases the number of fibers, the number of intersecting points or inter-fiber sealing points increases, thereby favorably preserving the formed porous structure.

7-3-5. Manufacturing Method and Netted Supporting Member

A manufacturing method of the nonwoven fabric 110 according to this embodiment is described below. At first, a fiber web 100 is placed on the topside of a netted supporting member 210 or a breathable supporting member. In other words, the fiber web 100 is supported by the netted supporting member 210 from below.

The netted supporting member 210 is then conveyed in a predetermined direction (machine direction: MD) while supporting the fiber web 100. The nonwoven fabric 110 according to this embodiment may then be manufactured by continuously blowing gas from the topside onto the fiber web 100 being conveyed.

In this case, the netted supporting member 210 is formed so that a plurality of wires 211 is woven together. A netted supporting member, in which a plurality of holes 233 or permeable portions is formed, is provided by weaving the plurality of wires 211 at predetermined intervals.

As mentioned above, the netted supporting member 210 of FIGS. 4A and 4B includes the plurality of small holes 233, and gas blown thereupon from the topside of the fiber web 100 passes through downward without being impeded by the netted supporting member 210. The netted supporting member 210 does not considerably change the flow of gas to be blown, and prevents the fibers 101 from displacing down (opposite side to the side on which the nonwoven fabric is placed) the netted supporting member.

Therefore, the fibers 101 in the fiber web 100 are displaced mainly from the topside by the gas blown thereupon. More specifically, the fibers 101 are displaced along the surface of the netted supporting member 210 or a planar direction orthogonal to a vertical direction, since displacing to the opposite side (lower side) of the netted supporting member 210 is controlled.

For example, the fibers 101 in regions onto which gas is blown are displaced to regions adjacent to those regions. Since the fiber web 100 is conveyed in a machine direction (MD) while gas is being blown thereupon, regions to which the fibers 101 are displaced are formed so as to be along the machine direction. In other words, the fibers 101 are displaced to lateral sides of regions onto which gas is blown.

In this manner, the fibers 101 oriented mainly in the machine direction (MD) are displaced to the lateral sides, forming the groove portions 1. The fibers 101 oriented in a direction (CD) orthogonal to the machine direction (MD) remain at the bottom of the groove portions 1. In addition, the raised ridge portions 2 are formed at lateral sides of the groove portions 1, or regions between the groove portions 1 adjacent to each other. At the lateral sides of the raised ridge portions 2 formed when the fibers 101 oriented in the machine direction (MD) are displaced from the regions where the groove portions 1 are formed, the fiber density increases, and the ratio of the fibers 101 oriented in a longitudinal direction increases.

The nonwoven fabric 110 according to this embodiment may be manufactured by way of the nonwoven fabric manufacturing apparatus 90. The description of the manufacturing method for the nonwoven fabric 110, and the nonwoven fabric manufacturing apparatuses 90 and 95 given above may serve as a reference for a manufacturing method for the nonwoven fabric by way of the nonwoven fabric manufacturing apparatus 90.

7-4. Second Embodiment

A nonwoven fabric according to a second embodiment of the present invention is described below while referring to FIGS. 6 through 9.

7-4-1. Overview

As illustrated in FIG. 6A, 6B, 7, or 9, a nonwoven fabric 120 according to this embodiment is a nonwoven fabric in which a plurality of openings 3 is formed.

The openings 3 are formed by displacing the fibers 101 constituting the fiber web 100 by blowting a fluid mainly containing gas thereupon from the topside, while supporting the fiber web 100 by the supporting member 220 or a breathable supporting member, as shown in FIGS. 8A and 8B, from the underside. In addition, fiber orientation, fiber density, or basis weight of the fibers 101 constituting the fiber web 100 is adjusted.

The supporting member 220 shown in FIGS. 8A and 8B is a supporting member manufactured by disposing a plurality of elongated members 225 substantially in parallel at predetermined intervals on the topside of a netted supporting member 210 of FIGS. 4A and 4B. The elongated members 225 are impermeable members. The elongated members 225 prevent fluid mainly containing gas blown from the upper side (second side) from passing through to the lower side (first side). In other words, flow direction of the fluid mainly containing gas blown onto the elongated members 225 is changed. More specifically, flow direction of most of the fluid mainly containing gas blown onto the elongated members 225 is changed to a direction along the surface of the elongated members 225.

In short, the fibers 101 constituting the fiber web 100 are displaced by fluid mainly containing gas blown from the upper side of the fiber web 100 and/or fluid mainly containing gas which is the blown fluid mainly containing gas that passes through the fiber aggregate and has changed flow direction by way of the elongated members 225. In other words, the fibers 101 in regions onto which a jet of fluid mainly containing gas is blown are displaced to regions adjacent to those blown regions. This forms the openings 3, and adjusts at least one of fiber orientation, fiber density, and basis weight of the fibers 101.

7-4-2. Groove Portions, Openings, or Protrusions

As illustrated in FIG. 6A, 6B, 7, or 9, the nonwoven fabric 120 according to this embodiment is a nonwoven fabric in which a plurality of openings 3 is formed, as described above. More specifically, the nonwoven fabric 120 is a nonwoven fabric in which a plurality of groove portions 1, which is formed on a first side of the nonwoven fabric 120 along a machine direction (MD), is formed in parallel at substantially equal intervals viewed from the machine direction (MD), and a plurality of openings 3 is formed along a direction in which the groove portions 1 are formed in the regions constituting the bottom of the groove portions 1. The plurality of respective openings 3 is formed into a circular or an elongated shape. In this embodiment, the groove portions 1 are formed in the machine direction (MD) in parallel at substantially equal intervals; however, they are not limited thereto. For example, they may be formed at different intervals, or may be formed not in parallel, but so that the intervals between the groove portions 1 vary. In addition, the raised ridge portions 2 may be formed so that the heights (thicknesses) thereof are not equal, but differ from each other.

A plurality of raised ridge portions 2 is formed between the plurality of respective groove portions 1. The raised ridge portions 2 are formed in parallel at substantially equal as with the groove portions 1. The heights (thickness direction) of the raised ridge portions 2 of the nonwoven fabric 120 according to this embodiment are substantially equal; however, the heights of the raised ridge portions 2 adjacent to each other may be formed so as to be different from each other. For example, the heights of the raised ridge portions 2 may be adjusted by adjusting the intervals of nozzles 913 from which fluid mainly containing gas is ejected. For example, the heights of the raised ridge portions 2 may be lowered by narrowing the intervals of the nozzles 913; on the contrary, the heights of the raised ridge portions 2 may be heightened by widening the intervals of the nozzles 913. Moreover, the raised ridge portions 2 differing in height may be formed alternately by forming the intervals of the nozzles 913 so as to alternate narrow intervals and wide intervals. Furthermore, it is possible to reduce the contact area with skin by forming at least a part of the plurality of raised ridge portions 2 such that the height thereof is lower. In short, it is also possible to provide a nonwoven fabric with less burden to the skin.

Connecting portions 4, which extend in a cross direction (CD), are formed between the openings 3 adjacent to each other. The connecting portions 4 are portions configuring the bottom of the groove portions 1, and portions where fibers 101 remain without being displaced. The connecting portions 4 are formed so as to connect the raised ridge portions 2 adjacent to each other. In other words, a plurality of connecting portions 4 connects the raised ridge portions 2 adjacent to each other.

7-4-3. Fiber Orientation, Fiber Density, or Basis Weight 7-4-3-1. Fiber Orientation As illustrated in FIG. 6A, 6B, 7, or 9, most of the fibers 101 at the bottom of the groove portions 1 are oriented in a width direction (CD), since fibers oriented in the width direction (direction orthogonal to machine direction: CD) remain after the fibers 101 disposed on the connecting portions 4 are displaced in a direction intersecting a longitudinal direction (machine direction: MD) of the groove portions 1; more specifically, the fibers 101 oriented in the longitudinal direction are displaced to the sides of the raised ridge portions 2 by blowing a fluid mainly containing gas (e.g., hot air) thereupon.

In addition, the fibers 101 disposed on the sides of the raised ridge portions 2 are mainly oriented in the longitudinal direction (MD) of the raised ridge portions 2. In short, the fibers 101 disposed on the sides of the raised ridge portions 2 are oriented in the longitudinal direction (MD). Fibers arranged on the sides of the raised ridge portions 2 are oriented so that the ratio of the fibers 101 disposed on the sides of the raised ridge portions 2 or the fibers oriented in the longitudinal direction is higher than the ratio of the fibers 101 disposed on the central portion (region between both ends) of the raised ridge portions 2 or the fibers 101 oriented in the longitudinal direction.

Fibers 101 around (periphery of) the openings 3 are oriented along the periphery of the openings 3. In other words, the fibers 101 disposed in the vicinity of both ends of the openings 3 viewed from the longitudinal direction (MD) of the groove portions 1 are oriented in a direction orthogonal to the longitudinal direction (MD). In addition, both ends of the openings 3 viewed from the width direction (CD) are oriented in the longitudinal direction (MD).

7-4-3-2. Fiber Density

Figure 7:
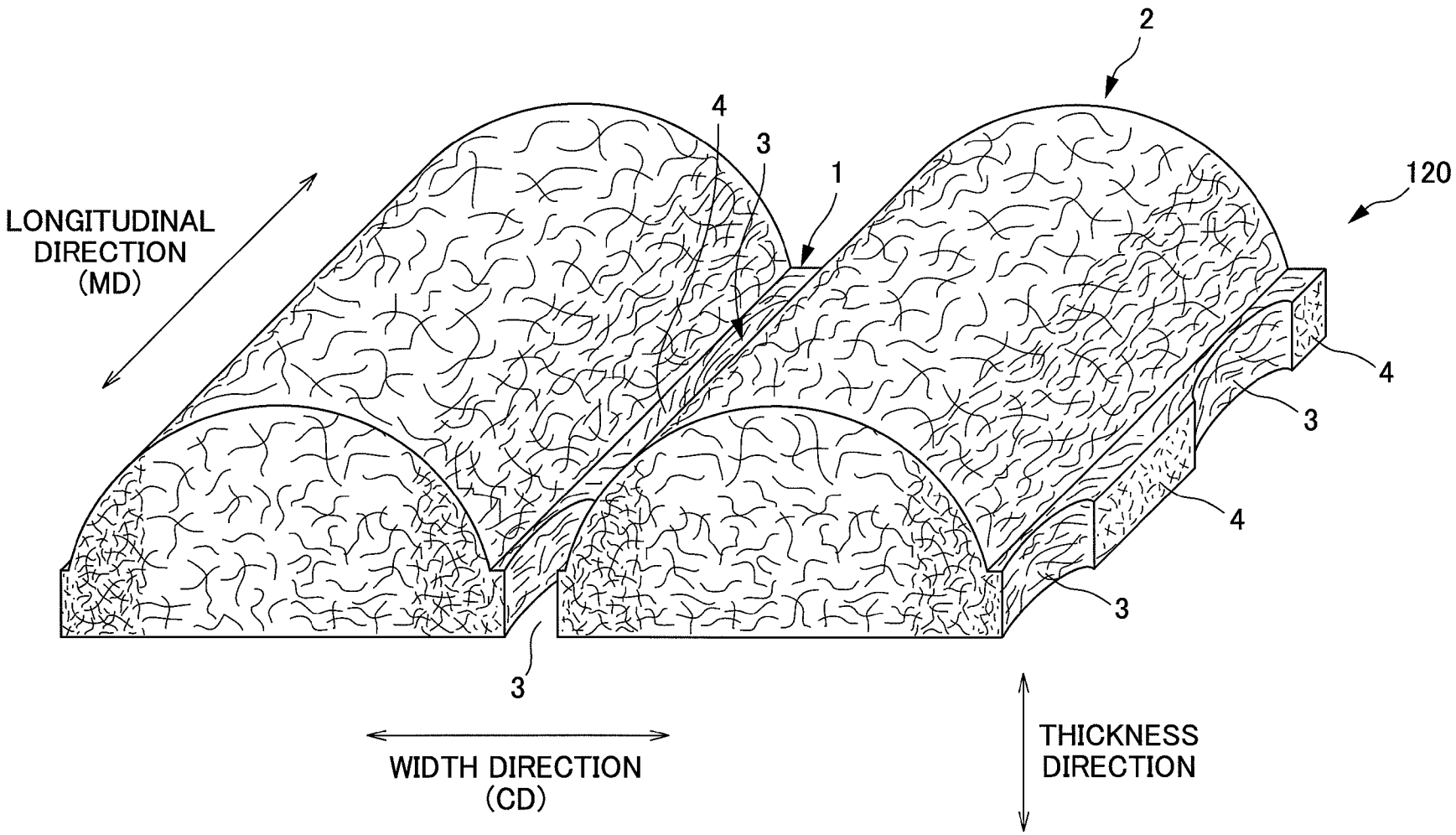
FIG. 7 is a magnified perspective view of the region Y of FIG. 6A.

As illustrated in FIG. 7, the fibers 101 oriented in the longitudinal direction (MD) are displaced to the sides of the raised ridge portions 2 by blowing hot air or the like thereupon. Therefore, the number of fibers 101 disposed on the sides of the raised ridge portions 2 and oriented in the longitudinal direction increases. This increases the number of intersecting points or inter-fiber sealing points, and also increases the fiber density, thereby further facilitating the preservation of the porous structure of the entire raised ridge portions 2. In addition, the fiber density of the connecting portions 4 constituting the bottom of the groove portions 1 is adjusted according to a shape and size of the openings 3.

7-4-3-3. Basis weight

As illustrated in FIG. 7, the basis weight at the bottom of the groove portions 1 is adjusted so as to be lower than that in the raised ridge portions 2. In addition, the basis weight at the bottom of the groove portions 1 is adjusted so as to be lower than the average basis weight of the entire nonwoven fabric, including the groove portions 1 and the raised ridge portions 2.

As mentioned above, the basis weight in the raised ridge portions 2 is adjusted so as to be higher than that at the bottom of the groove portions 1. In addition, the basis weight in the groove portions 1 is adjusted so as to be lower than the average basis weight in the entire nonwoven fabric, including the groove portions 1 and the raised ridge portions 2.

7-4-4. Other

When the nonwoven fabric of this embodiment is used to absorb or pass through a predetermined fluid, the bottom of the groove portions 1 allows the fluid to pass through, making it difficult for the raised ridge portions 2 to hold the fluid, since it is a porous structure. Moreover, the openings 3 formed in the groove portions 1 allow solid in addition to fluid to pass through.

Since a plurality of openings 3 is formed at the bottom of the groove portions 1, fluid and solid are favorably passed through. Moreover, since most of the fibers 101 at the bottom (connecting portion 4) of the groove portions 1 are oriented in the width direction, it is possible to prevent the fluid dripped into the groove portions 1 from excessively flowing and widely spreading in the longitudinal direction of the groove portions 1. Since the fibers 101 at the bottom of the groove portions 1 are oriented in the width direction (direction orthogonal to machine direction during manufacturing: CD), the sheet strength (CD strength) in the width direction (CD) is great regardless that the basis weight at the bottom of the groove portions 1 is low.

As described above, since adjustment such that the basis weight in the raised ridge portions 2 is high increases the number of fibers, the number of intersecting points or inter-fiber sealing points increases, and the formed porous structure is favorably preserved.

7-4-5. Manufacturing Method and Netted Supporting Member

The manufacturing method of the nonwoven fabric 120 according to this embodiment is described below. A first, the fiber web 100 is placed on the topside of the supporting member 220 or a breathable supporting member. In other words, the fiber web 100 is supported by the supporting member 220 from below.

The netted supporting member 210 is then conveyed in a predetermined direction (machine direction: MD), while supporting the fiber web 100. The nonwoven fabric 120 according to this embodiment may then be manufactured by continuously blowing gas onto the fiber web 100 being displaced from the topside.

The supporting member 220 is placed on a conveyer so that the elongated members 225 are disposed in a direction (CD) orthogonal to the machine direction (MD). The supporting member 220 on the topside of which the fiber web 100 is placed is then conveyed in the machine direction (MD). This continuously blows gas onto the topside of the fiber web 100 in a direction substantially orthogonal to a direction in which the elongated members 225 extend. In short, the groove portions 1 are formed in a direction substantially orthogonal to the machine direction (MD), or a direction in which the elongated members 225 extend. In addition, the openings 3 to be described later are formed in regions arranged on the topside of the elongated members 225 of the regions where the groove portions 1 are formed.

As described above, the supporting member 220 is a supporting member which is configured by disposing a plurality of elongated members 225 substantially in parallel at predetermined intervals on the topside of a netted supporting member 210 of FIGS. 4A and 4B. The elongated members 225 are impermeable members and prevent gas blown from the upper side (second side) from passing through to the lower side (first side). In other words, the flow direction of the gas blown onto the elongated members 225 is changed.

In addition, the elongated members 225 prevent the fibers 101 constituting the fiber web 100 from displacing from the upper side (second side) to the lower side (first side) of the supporting member 220.

Accordingly, the fibers 101 constituting the fiber web 100 are displaced by at least one of gas blown from the topside of the fiber web 100 and gas that passes through the fiber web 100 and has changed flow direction by way of the elongated members 225.

The fibers 101 in regions onto which gas is blown are displaced to regions adjacent to those regions. More specifically, the fibers 101 oriented in the machine direction (MD: longitudinal direction) are displaced in a direction orthogonal to the machine direction (CD: width direction).

This forms the groove portions 1. The fibers 101 which are not displaced, and remain are oriented in the width direction (CD) and constitute the bottom of the groove portions 1. In short, the fibers 101 constituting the bottom of the groove portions 1 are oriented in the width direction (CD). In addition, the raised ridge portions 2 are formed between the groove portions 1 adjacent to each other. At the lateral portions of the raised ridge portions 2, the fiber density increases because of the displaced fibers 101 described above, and the ratio of the fibers 101 constituting the lateral portions disposed so as to be oriented in a longitudinal direction (MD) increases.

In addition, blown gas or gas which passes through the fiber web 100 and has changed flow direction by way of the elongated members 225 also displaces the fibers 101 constituting the fiber web 100 in a direction different from the aforementioned direction.

Since the netted supporting member 210 and the elongated members 225 constituting the supporting member 220 control the fibers 101 to displace the lower side or opposite side to a side of the supporting member 220 on which the fiber web 100 is placed, the fibers 101 are displaced in a direction along the topside or side of the supporting member 220 on which the fiber web 100 is placed.

More specifically, the flow direction of gas blown onto the elongated members 225 is changed so that the gas flows along the surface of the elongated members 225. The gas having changed flow direction in this manner displaces the fibers 101 disposed on the topside of the elongated members 225 from the topside of the elongated members 225 to surrounding regions. This forms the openings 3 in a predetermined shape, and adjusts at least one of fiber orientation, fiber density, and basis weight of the fibers 101.

The nonwoven fabric 120 according to this embodiment may be manufactured by way of the nonwoven fabric manufacturing apparatus 90 to be described later. Description of the manufacturing method for the nonwoven fabric 120, and the nonwoven fabric manufacturing apparatuses 90 and 95 given above may serve as a reference for a manufacturing method of the nonwoven fabric by way of the nonwoven fabric manufacturing apparatus 90.

In addition, it is possible to provide the nonwoven fabric 120 of this embodiment by adjusting temperature, amount, or strength of fluid mainly containing gas to be blown onto the fiber web 100, and adjusting tension or the like by adjusting a conveying rate of the fiber web 100 by way of the conveying mechanism, even if the supporting member 220 shown in FIGS. 11A and 11B is used.

7-5. Third Embodiment

A nonwoven fabric according to a third embodiment of the present invention is described below while referring to FIGS. 10 to 13.

7-5-1. Overview

As illustrated in FIG. 10A, 10B, 12, or 13, a nonwoven fabric 130 according to this embodiment is a nonwoven fabric in which a plurality of protrusions 7, which protrude from one side of the nonwoven fabric, is formed.

The protrusions 7 are formed by blowing fluid mainly containing gas from the topside of a fiber web 100, which is supported so as to allow for displacing on the surface of the flat supporting member 230, onto a flat supporting member 230 in which a plurality of holes 233 is formed. More specifically, the protrusions 7 are formed so that fibers 101 constituting the fiber web 100 are displaced by blown fluid mainly containing gas so as to enter the plurality of respective holes 233, and protrude in a thickness direction of the fiber web 100. In addition, this allows for adjustment of fiber orientation, fiber density, or basis weight of the fibers 101 constituting the fiber web 100.

The flat supporting member 230 shown in FIGS. 11A and 11B is a plate shaped member in which a plurality of holes 233 is formed. More specifically, the flat supporting member 230 is configured with plate portions 235 or impermeable portions, and the holes 233 or second permeable portions.

The plate portions 235 are impermeable members and prevent gas blown from the upper side from passing through to the lower side. In other words, the flow direction of the gas blown onto the plate portions 235 is changed.

The holes 233 are portions where gas may pass through. The gas blown from the upper side (second side) onto the holes 233 passes through to the lower side (first side) of the flat supporting member 230. In addition, in the holes 233, the fibers 101 constituting the fiber web 101 may displace to the lower side of the flat supporting member 230 so as to enter the holes 233.

The fibers 101 constituting the fiber web 100 are displaced by at least one of fluid mainly containing gas blown from the topside of the fiber web 100 and fluid mainly containing gas which is the blown fluid mainly containing gas which passes through the fiber web 100 and has changed flow direction by way of the plate portions 235.

Since the fiber web 100 is supported by way of the flat supporting member so as to allow for displacing along the surface of the flat supporting member 230, the fiber web 100 displaces in a machine direction (MD) a distance of the fibers 101 constituting the fiber web 100 entering the holes 233. This allows for continuous formation of the protrusions 7. One or more of orientation, density, and weight of the fibers 101 is adjusted at the same time as formation of the protrusions 7.

7-5-2. Groove Portions, Openings, or Protrusions

Figure 10A:
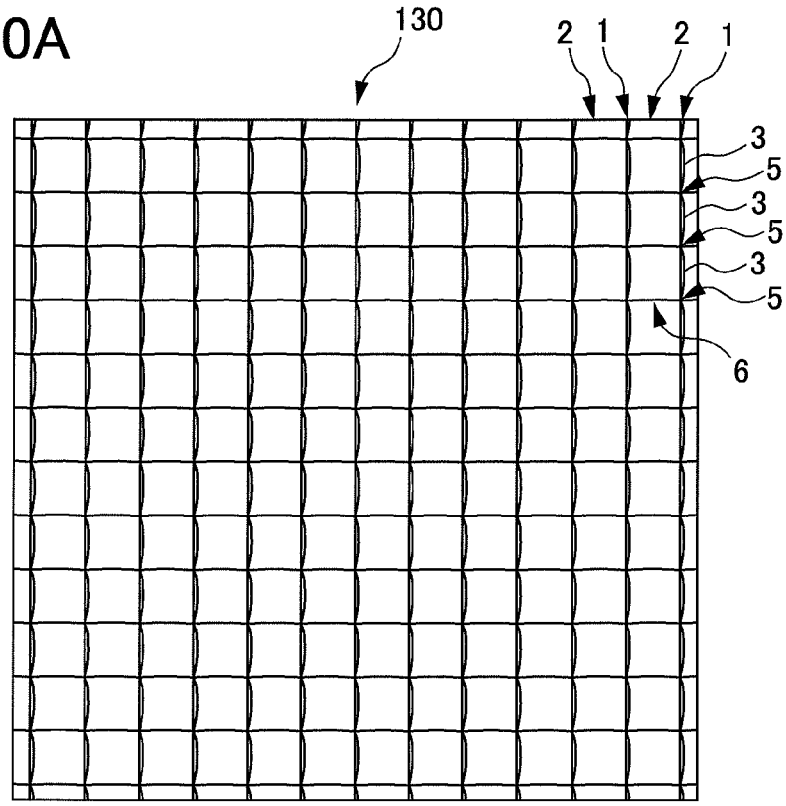
FIG. 10A is a plan view of a nonwoven fabric of a third embodiment.
Figure 10B:
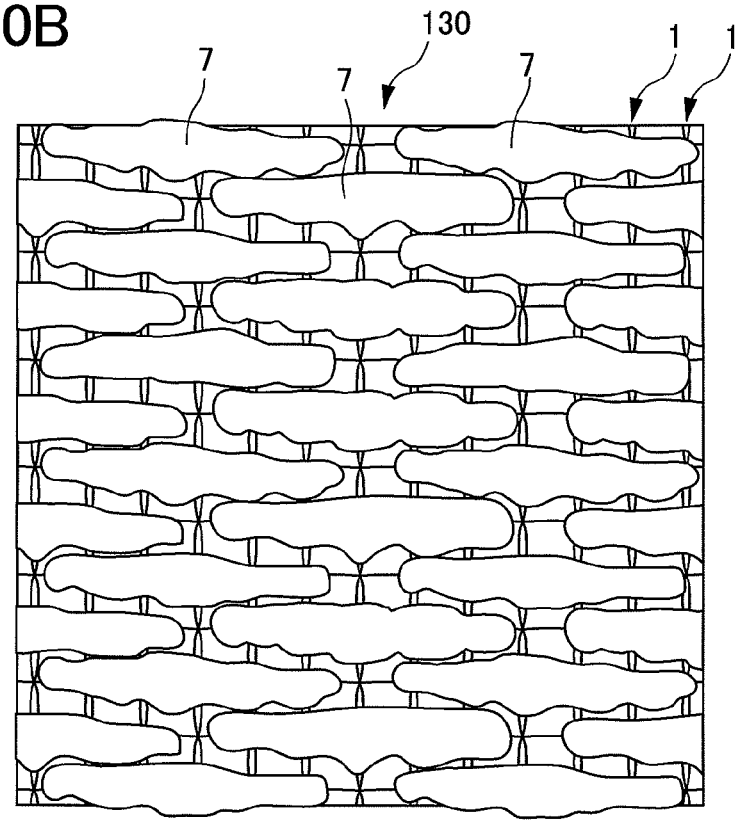
FIG. 10B is a bottom view of a nonwoven fabric of a third embodiment.

As illustrated in FIG. 10A, 10B, 12, or 13, a nonwoven fabric 130 according to this embodiment is a nonwoven fabric in which protrusions 7 or raised ridge portions which protrude from one side are formed in plural. In addition, as illustrated in FIG. 10A, it is a nonwoven fabric in which a plurality of groove portions 1 is formed in parallel at substantially equal intervals, and a plurality of openings 3 is formed along the groove portions 1 on an opposite side to the side from which the protrusions 7 protrude.

The protrusions 7 are formed when fibers, which are disposed in regions between openings 3 adjacent to each other formed along the groove portions 1, enter the holes 233. This forms concave portions 5 with a predetermined length in a direction substantially orthogonal to the groove portions 1 on the opposite side to the side from which the protrusions 7 protrude. The concave portions 5 are formed in a groove shape with a length substantially equal to the length of the holes 233 as viewed from the opposite side between one basal portion and the other basal portion of the protrusions 7, which are formed by the fibers 101 that have entered the holes 233.

In this embodiment, the concave portions 5 are formed collectively in a linear shape along a direction orthogonal to the groove portions 1. In addition, as illustrated in FIG. 10A, since a plurality of openings 3 is formed on which so as to be continuous in a predetermined direction (MD), a substantially straight line formed by a plurality of continuous concave portions 5 is formed so as to extend in a direction (MD) substantially orthogonal thereto.

Figure 13:
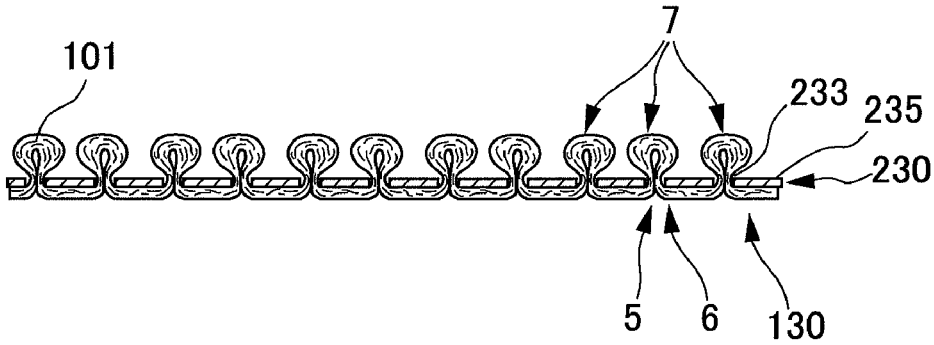
FIG. 13 is a cross-sectional view taken along the line A-A of FIG. 12.

In addition, the protrusions 7 with a predetermined length (height) are formed in plural on one side such that the fibers 101 constituting the fiber web 100 enter the holes 233. As illustrated in FIG. 13, the protrusions 7 include basal portions, which are narrow regions where the fiber web 100 is arranged such that they face each other, and arched portions in an arched shape wider than the basal portions and formed so as to swell alternately with the basal portions in a thickness direction. In this case, the protrusions 7 of this embodiment are in an arched shape; however, protrusions having cross-sectional shape in a planar direction triangular (triangular pole), protrusions that are triangular and having tops are curved in a thickness direction, protrusions in a square (square pole) shape, or these protrusions which slant away from the thickness direction may be exemplified as other embodiments. In addition, adjustment of a temperature of fluid mainly containing gas allows for sealing of the basal portions, and overall sealing including the basal portions, and prevention of sealing just the basal portions.

The width of the basal portions of the protrusions 7 is defined by the width (opening size) of the holes 233. In addition, the length of the protrusions 7 in a longitudinal direction is defined by the length (opening size) of the holes 233 in the longitudinal direction. Moreover, the height (length of the nonwoven fabric 130 in the thickness direction) of the protrusions 7 is adjusted according to the shape of the holes 233, the length of the fibers 101, and intensity and amount of gas to be blown. For example, when fluid mainly containing gas (e.g., hot air) is intensely blown, when a large amount of fluid mainly containing gas is blown, when hardly any line tension is applied to the fiber web 100, or when the fiber web 100 is slightly overfed just before fluid mainly containing gas (e.g., hot air) is blown thereupon, it is easier for the fibers 101 to enter the holes 233. In addition, a three-dimensional netted supporting member constituted with thick wires where the holes in the netted supporting member 210 are large, may be exemplified as the breathable supporting member 200. The holes of the netted supporting member are the second permeable portions, and allow the fibers 101 constituting the fiber web 100 to displace to an opposite side to a side on which the fiber web 100 of the netted supporting member is supported. This allows for formation of the protrusions 7, which protrude in a thickness direction. In addition, since the wires constituting the netted supporting member are thick, the fibers 101 constituting the fiber web 100 displace along the shape of the surface of the netted supporting member, allowing a nonwoven fabric on which protrusions protrude in a zigzag form to be provided, for example.

When the nonwoven fabric 130 is viewed from one side, a plurality of protrusions 7, a plurality of substantially square flat portions formed between the plurality of respective protrusions 7, and openings 3 formed on both sides of the plurality of respective flat portions are formed evenly.

7-5-3. Fiber Orientation, Fiber Density, or Basis Weight

Figure 12:
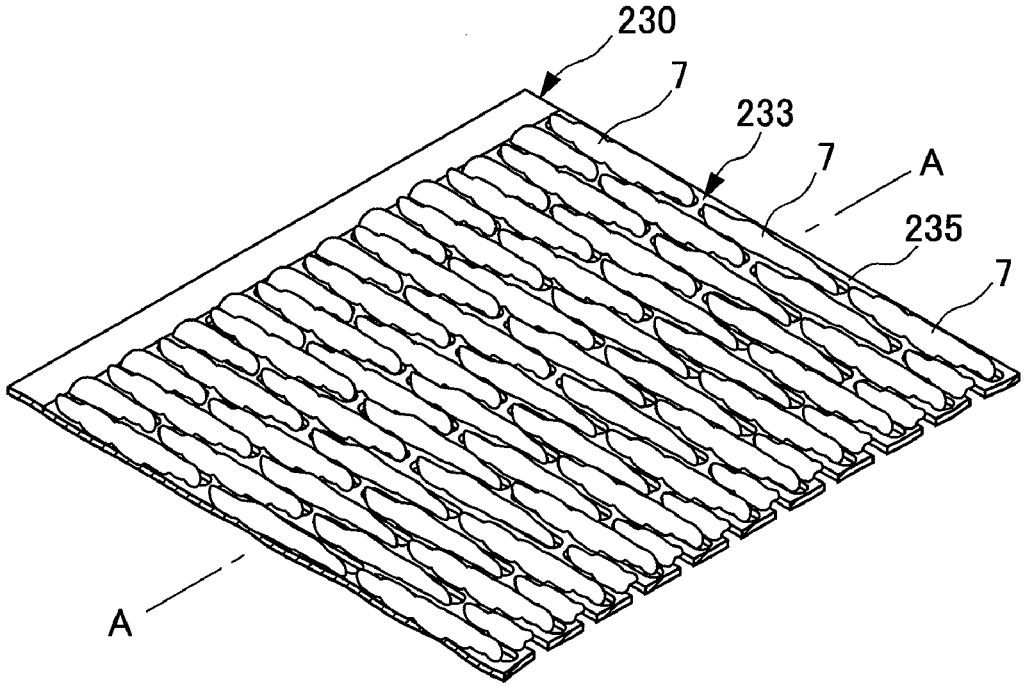
FIG. 12 is a diagram illustrating the nonwoven fabric of the third embodiment in FIGS. 10A and 10B being manufactured by blowing a gas onto the topside of the fiber web of FIG. 1, while the underside is supported by the flat supporting member of FIGS. 11A and 11B.

As illustrated in FIG. 13, the fibers 101 in the protrusions 7 are oriented along the periphery of the protrusions 7 from the respective basal portions in an arched shape. The fiber density in the protrusions 7 is higher than that in the other regions, such as flat portions. The fiber density in the parietal region of the protrusions 7 is especially high. In addition, as illustrated in FIG. 12 or 13, in a thickness direction of the nonwoven fabric 130, the amount of the fibers 101 arranged in the regions where the protrusions 7 are formed is greater than in the other regions where the protrusions 7 are not formed.

7-5-4. Other

If raised ridge portions are used as a surface sheet of an absorbent article facing downward, or on the opposite side to a side on which fluid drips, it is easy to transfer fluid from the surface on which fluid drips downward to the opposite side since the fiber density of the protrusions 7 increases toward the parietal region (absorber side of the product) and fiber orientation is downward. In addition, if the protrusions 7 are used as a surface sheet of an absorbent article facing upward or on the side on which fluid drips, it is possible to minimize friction with the skin since the contact area between the nonwoven fabric and the skin considerably decreases, and the protrusions 7 may deform starting at the basal portions or shift to the parietal region.

Since a plurality of openings 3 is formed at the basal portions of the protrusions 7, they are suitable for passing fluid and solid through.

When the nonwoven fabric 130 is used so as to contact the human body, good usability is provided because of its superior cushioning characteristics. In addition, when it is used so as to contact an object, it is suitable for protecting the object because of its superior cushioning characteristics. Moreover, since a plurality of protrusions 7 protruding in the thickness direction of the nonwoven fabric is formed, it is suitable for wiping the surface of an object.

7-5-5. Manufacturing Method and Netted Supporting Member

A manufacturing method of the nonwoven fabric 130 according to this embodiment is described below. At first, a fiber web 100 is placed on the topside of a flat supporting member 230 or breathable supporting member. In other words, the fiber web 100 is supported by the flat supporting member 230 from below.

The nonwoven fabric 130 of this embodiment may then be manufactured by conveying the flat supporting member 230 in a predetermined direction while supporting the fiber web 100, and continuously blowing a gas thereupon from the topside of the fiber web 100, which is being conveyed.

Holes formed in the flat supporting member 230 are elongated with a large difference between the minor axis and major axis. The flat supporting member 230 is disposed so that the longitudinal direction or major axis direction of the holes is orthogonal to the machine direction (MD). In other words, the flat supporting member 230 on the topside of which the fiber web 100 is placed is then conveyed in a direction substantially orthogonal to the longitudinal direction of the holes 233. In short, a jet of gas is continuously blown onto the topside of the fiber web 100 in a direction substantially orthogonal to the longitudinal direction of the holes 233. The groove portions 1 are formed in a direction substantially orthogonal to the longitudinal direction of the holes 233. The protrusions 7, which are described later, are then formed at the positions where the holes 233 are formed.

As described above, the flat supporting member 230 is a plate shaped supporting member in which a plurality of holes 233 is formed, as illustrated in FIGS. 11A and 11B. More specifically, it is a plate shaped supporting member including plate portions 235 and a plurality of holes 233. The plate portions 235 are impermeable members. The plate portions 235 do not allow gas blown from the upper side or a second side of the plate portions 235 to pass through to the lower side or a first side. In other words, the flow direction of the gas blown onto the plate portions 235 is changed.

In addition, the plate portions 235 do not allow the fibers 101 constituting the fiber web 100 to displace to the lower side or opposite side to the side of the flat supporting member 230 on which the fiber web 100 is supported.

Accordingly, the fibers 101 constituting the fiber web 100 are displaced by at least one of gas blown from the topside of the fiber web 100 and the blown gas which passes through the fiber web 100 and has changed flow direction by way of the plate portions 235.

The fibers 101 in regions onto which gas is blown are displaced to regions adjacent to those regions. More specifically, the fibers 101 oriented in the machine direction (MD: longitudinal direction) are displaced in a direction orthogonal to the machine direction (CD: width direction).

In addition, the fibers 101 constituting the fiber web 100 are displaced in a direction different from the aforementioned direction by blown gas that passes through the fiber web 100 and has changed flow direction by way of the elongated members 225.

The fibers 101 disposed on the topside of the plate portions 235 are disposed in a longitudinal direction along the surface of the plate portions 235. More specifically, the flow direction of the gas blown onto the plate portions 235 is changed to a direction along the surface of the plate portions 235. The gas having changed flow direction displaces the fibers 101 disposed on the topside of the plate portions 235 from the topside of the plate portions 235 to surrounding regions by displacing them along the surface of the plate portions 235. This forms the openings 3 in a predetermined shape. In addition, at least one of orientation, density, and weight of the fibers 101 is adjusted.

In addition, in the holes 233, the fibers 100 constituting the fiber web 101 may displace to the lower side of the flat supporting member 230.

Accordingly, the fibers 101 constituting the fiber web 100 are displaced by gas blown thereupon from the topside of the fiber web 100 so as to enter the holes 233. This forms a plurality of protrusions 7 protruding to the opposite side to a side on which the groove portions 1 are formed.

In other words, the protrusions 7 protruding to the first side are formed when regions formed between the openings 3 adjacent to each other enter the holes 233. Since the protrusions 7 are formed so that a part of the protrusions 7 of the flat fiber web 100 enters the holes 233, the fiber web 100 with a predetermined thickness is in a folded form such that the basal portions face each other. The portions protruding to the first side spread wider than the width of the basal portions, forming the protrusions 7 in an arched shape in their entirety.

In this case, as described above, the width of the basal portions of the protrusions 7 viewed from the machine direction (MD) is defined by the width of the holes 233 viewed from the machine direction (MD) (width direction of the protrusions). In addition, the width (length) of the protrusions 7 viewed from the cross direction (CD) is defined by the width (length) of the holes 233 viewed from the cross direction (CD) (longitudinal direction of the protrusions). Moreover, the height (length of the nonwoven fabric 130 in the thickness direction) of the protrusions 7 is defined according to the shape of the holes 233, the length of the fibers 101, and intensity and amount of gas to be blown.

Viewed from the first side, a plurality of protrusions 7, a plurality of substantially square flat portions formed between the plurality of respective protrusions 7, and openings 3 formed on a pair of sides of the plurality of respective flat portions, are formed evenly in the nonwoven fabric 130.

The nonwoven fabric 130 according to this embodiment may be manufactured by way of the nonwoven fabric manufacturing apparatus 90, which is described later. The description of the manufacturing method for the nonwoven fabric 130, and the nonwoven fabric manufacturing apparatuses 90 and 95 given above may serve as a reference for a manufacturing method for the nonwoven fabric by way of the nonwoven fabric manufacturing apparatus 90.

7-6. Other

A fiber web configured by overlapping multiple fiber webs having different properties and functions may be used as the fiber web of the aforementioned embodiment. This allows for a nonwoven fabric with different functions to be provided. In addition, it is possible to provide various nonwoven fabrics by stacking and arranging the nonwoven fabric of the aforementioned embodiment so as to overlap the flat nonwoven fabric.

8. Applications

As applications of the nonwoven fabric of the present invention, a top sheet and the like of an absorbent article such as a sanitary napkin, a liner, and a diaper, for example, may be exemplified. In this case, raised ridge portions may be formed facing either a skin side or an underside on the opposite side to the skin side; however, if the raised ridge portions are formed on the skin side, a feeling of moistness due to body fluid may become difficult since the contact area with the skin decreases. In addition, it may be used as an intermediate sheet between the top sheet of the absorbent article and an absorber. In this case, it may be difficult to induce reverse flow from the absorber since the contact area with the top sheet or the absorber decreases. Moreover, it may be preferably used as a side sheet of an absorbent good, outer surface (external wrapping material) of a diaper, a female hook-and-loop fastener material, and the like, because of a decrease in the contact area with the skin, and cushioning characteristics. Furthermore, it may be used for various applications such as a wiper for removing dust and grime adhered to floors and body, a mask, and a breast feeding pad.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A nonwoven fabric manufacturing method, comprising the steps of:

supporting a first side of a fiber aggregate on a predetermined side of a breathable supporting member;

conveying the fiber aggregate, which is supported by the breathable supporting member, by way of a predetermined conveying mechanism in a machine direction; and blowing a fluid onto an opposite, second side of the fiber aggregate, which is being conveyed in the machine direction in the conveying step by way of a predetermined blowing device, wherein the breathable supporting member includes elongated members placed in a predetermined pattern on the predetermined side of a net member, and the elongated members are arranged at predetermined regular intervals in the machine direction and elongated in a cross section substantially perpendicular to the machine direction.

2. The nonwoven fabric manufacturing method according to claim 1, wherein the blowing step adjusts at least one of fiber orientation, fiber density, or basis weight of the nonwoven fabric, and forms at least one of a groove portion, an opening, or a protrusion in the nonwoven fabric.

3. The nonwoven fabric manufacturing method according to claim 1, wherein the fiber aggregate comprises thermoplastic fibers that have a predetermined softening temperature, and the fluid is blown by the blowing device onto the second side of the fiber aggregate at a temperature which is higher than the predetermined softening temperature of the thermoplastic fibers to soften or melt the fiber aggregate.

4. The nonwoven fabric manufacturing method according to claim 1, wherein the breathable supporting member comprises:

a permeable portion defined by mesh holes of the net member and allowing the fluid blown onto the fiber aggregate to pass through from the second side of the fiber aggregate to the first side of the fiber aggregate; and an impermeable portion defined by the elongated members that do not allow the fluid blown onto the fiber aggregate to pass through the fiber aggregate, and do not allow fibers constituting the fiber aggregate to displace to the first side of the fiber aggregate.

5. The nonwoven fabric manufacturing method according to claim 1, wherein the breathable supporting member comprises a first permeable portion defined by mesh holes of the net member that do not allow fibers constituting the fiber aggregate to substantially displace to the first side of the fiber aggregate.

6. The nonwoven fabric manufacturing method according to claim 1, wherein the breathable supporting member has a shape of a plate.

7. The nonwoven fabric manufacturing method according to claim 1, wherein the breathable supporting member has a cylindrical shape.

8. The nonwoven fabric manufacturing method according to claim 1, wherein the breathable supporting member is selected from a plurality of different breathable supporting members.

9. The nonwoven fabric manufacturing method according to claim 1, wherein the conveying step comprises:

a first conveying step of conveying the fiber aggregate in the machine direction towards the blowing device; and a second conveying step subsequent to the first conveying step of conveying the fiber aggregate in the machine direction away from the blowing device, wherein, a first conveying rate of the fiber aggregate in the first conveying step is faster than a second conveying rate of the fiber aggregate in the second conveying step.

10. The nonwoven fabric manufacturing method according to claim 1, wherein the blowing device comprises a gas ejecting unit having a plurality of nozzles disposed at predetermined intervals along the cross direction so as to face the second side of the fiber aggregate, wherein the fluid is ejected from the plurality of respective nozzles onto the second side of the fiber aggregate.

11. The nonwoven fabric manufacturing method according to claim 4, wherein in the blowing step, a predetermined groove portion is formed in the nonwoven fabric by blowing the fluid onto a region of the fiber aggregate that is supported by the mesh holes of the net member.

12. The nonwoven fabric manufacturing method according to claim 4, wherein in the blowing step, a predetermined opening is formed in the nonwoven fabric by blowing the fluid onto a region of the fiber aggregate that is supported by the elongated members of the breathable supporting member.

13. The nonwoven fabric manufacturing method according to claim 1, wherein in the blowing step, the fluid is continuously blown onto the second side of the fiber aggregate.

14. The nonwoven fabric manufacturing method according to claim 1, wherein, in the blowing step, at least one of:

(i) the fluid, and (ii) the fluid having passed through the fiber aggregate and changed its flow direction by the elongated members, displaces the fibers constituting the fiber aggregate.

15. The nonwoven fabric manufacturing method according to claim 1, wherein the fluid includes gas.

16. The nonwoven fabric manufacturing method according to claim 1, wherein the elongated members are linear stripes arranged parallel to each other.

17. The nonwoven fabric manufacturing method according to claim 1, wherein the fluid is gas including solid.

18. The nonwoven fabric manufacturing method according to claim 1, wherein the fluid is gas including liquid particles.

19. The nonwoven fabric manufacturing method according to claim 1, wherein the blowing step comprises blowing the fluid onto a region of the fiber aggregate that is supported by the elongated members of the breathable supporting member; and softening the fiber aggregate by the blown fluid which has at a temperature which is higher than a predetermined softening temperature of the fiber aggregate.

20. The nonwoven fabric manufacturing method according to claim 1, wherein in the blowing step, a groove portion is formed in the nonwoven fabric by blowing the fluid onto a region of the fiber aggregate that is supported by mesh holes of the net member;

an opening is formed in the nonwoven fabric by blowing the fluid onto a region of the fiber aggregate that is supported by the elongated members of the breathable supporting member;

a protrusion is formed in the nonwoven fabric by fibers of the first aggregate that are displaced by the fluid.

21. The nonwoven fabric manufacturing method according to claim 19, wherein, in the blowing step, a groove portion is formed in the nonwoven fabric by blowing the fluid onto a region of the fiber aggregate that is supported by mesh holes of the net member;

an opening is formed in the nonwoven fabric by blowing the fluid onto a region of the fiber aggregate that is supported by the elongated members of the breathable supporting member;

a protrusion is formed in the nonwoven fabric by fibers of the first aggregate that are displaced by the fluid.

22. A nonwoven fabric manufacturing apparatus, comprising:

a breathable supporting member for supporting a first side of a fiber aggregate;

a blowing device for blowing fluid from an opposite, second side of the fiber aggregate; and a conveying mechanism for conveying the fiber aggregate in a machine direction to and from the blowing device, wherein the breathable supporting member includes elongated members placed in a predetermined pattern on the predetermined side of a net member, and the elongated members are arranged at predetermined regular intervals in the machine direction and elongated in a cross section substantially perpendicular to the machine direction.

* * * * *